US008374882B2

(12) United States Patent
Shirakawa et al.

(10) Patent No.: US 8,374,882 B2
(45) Date of Patent: Feb. 12, 2013

(54) PARAMETRIC STEREOPHONIC AUDIO DECODING FOR COEFFICIENT CORRECTION BY DISTORTION DETECTION

(75) Inventors: Miyuki Shirakawa, Fukuoka (JP); Masanao Suzuki, Kawasaki (JP); Yoshiteru Tsuchinaga, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 533 days.

(21) Appl. No.: 12/634,527

(22) Filed: Dec. 9, 2009

(65) Prior Publication Data

US 2010/0153120 A1 Jun. 17, 2010

(30) Foreign Application Priority Data

Dec. 11, 2008 (JP) ..... 2008-315150

(51) Int. Cl.
*G10L 19/02* (2006.01)
*H04R 5/00* (2006.01)

(52) U.S. Cl. ..... 704/500; 704/501; 381/2

(58) Field of Classification Search ..... 704/201, 704/220, 500, 501; 381/1, 2, 17
See application file for complete search history.

(56) References Cited

U.S. PATENT DOCUMENTS

| | | | | |
|---|---|---|---|---|
| 7,200,561 | B2 * | 4/2007 | Moriya et al. | 704/500 |
| 7,382,886 | B2 | 6/2008 | Henn et al. | |
| 7,447,317 | B2 * | 11/2008 | Herre et al. | 381/23 |
| 7,555,434 | B2 * | 6/2009 | Nomura et al. | 704/500 |
| 7,822,617 | B2 * | 10/2010 | Taleb et al. | 704/500 |
| 7,848,931 | B2 * | 12/2010 | Miyasaka et al. | 704/500 |
| 8,073,687 | B2 * | 12/2011 | Suzuki et al. | 704/220 |
| 8,108,220 | B2 * | 1/2012 | Saunders et al. | 704/500 |
| 8,170,882 | B2 * | 5/2012 | Davis | 704/500 |
| 2005/0053242 | A1 | 3/2005 | Henn et al. | |
| 2005/0149322 | A1 | 7/2005 | Bruhn et al. | |
| 2005/0226426 | A1 | 10/2005 | Oomen et al. | |
| 2005/0254446 | A1 | 11/2005 | Breebaart | |
| 2006/0023888 | A1 | 2/2006 | Henn et al. | |
| 2006/0023891 | A1 | 2/2006 | Henn et al. | |

(Continued)

FOREIGN PATENT DOCUMENTS

| | | |
|---|---|---|
| EP | 1355428 | 1/2002 |
| JP | 2004-535145 | 11/2004 |

(Continued)

OTHER PUBLICATIONS

Japanese Office Action issued on Sep. 25, 2012 in corresponding Japanese Patent Application No. 2008-315150.

*Primary Examiner* — Martin Lerner
(74) *Attorney, Agent, or Firm* — Staas & Halsey LLP

(57) ABSTRACT

An audio decoding method includes: acquiring, from encoded audio data, a reception audio signal and first auxiliary decoded audio information; calculating coefficient information from the first auxiliary decoded audio information; generating a decoded output audio signal based on the coefficient information and the reception audio signal; decoding to result in a decoded audio signal based on the first auxiliary decoded audio signal and the reception audio signal; calculating, from the decoded audio signal, second auxiliary decoded audio information corresponding to the first auxiliary decoded audio information; detecting a distortion caused in a decoding operation of the decoded audio signal by comparing the second auxiliary decoded audio information with the first auxiliary decoded audio information; correcting the coefficient information in response to the detected distortion; and supplying the corrected coefficient information as the coefficient information when generating the decoded output audio signal.

18 Claims, 22 Drawing Sheets

U.S. PATENT DOCUMENTS

| | | | | |
|---|---|---|---|---|
| 2006/0023895 | A1 | 2/2006 | Henn et al. | |
| 2006/0029231 | A1 | 2/2006 | Henn et al. | |
| 2007/0127585 | A1* | 6/2007 | Suzuki et al. | 375/265 |
| 2008/0071549 | A1 | 3/2008 | Chong et al. | |
| 2008/0097750 | A1* | 4/2008 | Seefeldt et al. | 704/201 |
| 2008/0170711 | A1 | 7/2008 | Breebaart et al. | |
| 2008/0192941 | A1* | 8/2008 | Oh et al. | 381/17 |
| 2008/0205658 | A1* | 8/2008 | Breebaart | 381/17 |
| 2008/0255860 | A1* | 10/2008 | Osada | 704/503 |
| 2008/0260170 | A1* | 10/2008 | Nakano | 381/59 |
| 2009/0010440 | A1* | 1/2009 | Jung et al. | 381/1 |
| 2009/0083040 | A1 | 3/2009 | Myburg et al. | |
| 2009/0129601 | A1* | 5/2009 | Ojala et al. | 381/1 |
| 2009/0234656 | A1* | 9/2009 | Oh et al. | 704/500 |
| 2009/0287495 | A1* | 11/2009 | Breebaart et al. | 704/500 |
| 2010/0080397 | A1* | 4/2010 | Suzuki et al. | 381/22 |

FOREIGN PATENT DOCUMENTS

| | | | |
|---|---|---|---|
| JP | 2005-523624 | | 8/2005 |
| JP | 2007-79487 | A1 | 3/2007 |
| JP | 2008-26914 | A1 | 2/2008 |
| JP | 2008-519306 | | 6/2008 |
| JP | 2002-223167 | | 8/2012 |
| WO | 03/007656 | A1 | 1/2003 |
| WO | 2006/003891 | A1 | 1/2006 |

* cited by examiner

PARAMETRIC STEREOPHONIC AUDIO DECODING FOR COEFFICIENT CORRECTION BY DISTORTION DETECTION

CROSS-REFERENCE TO RELATED APPLICATIONS

This application is based upon and claims the benefit of priority from the prior Japanese Patent Application No. 2008-315150 filed on Dec. 11, 2008, the entire contents of which are incorporated herein by reference.

FIELD

The embodiment to be discussed herein relates to an encoding technique for compressing and decompressing an audio signal. The embodiment is also related to an audio encoding and decoding technique, in accordance with which a decoder side reproduces an original audio signal based on a decoded audio signal and a decoded auxiliary signal. For example, the audio encoding and decoding technique includes a parametric stereophonic encoding technique for generating a pseudo-stereophonic signal from a monophonic signal.

BACKGROUND

The parametric stereophonic encoding technique is adopted in the high-efficiency advanced audio coding (HE-AAC) version 2 standard (hereinafter referred to as "HE-AAC v2"), as one of the MPEG-4 Audio standards. The parametric stereophonic encoding technique as an audio compression technique substantially improves a codec efficiency of a low-bit rate stereophonic signal, and is optimum for applications in mobile devices, broadcasting, and the Internet.

FIG. 16 illustrates a model for stereophonic recording. In this model, two microphones #1 and #2, namely, microphones 16011 and 16012 pick up a sound emitted from a sound source x(t). Here, $c_1x(t)$ represents a direct-path wave reaching the microphone 16011 and $c_2h(t)*x(t)$ represents a reflected wave reaching the microphone 16011 after being reflected off walls of a room. Here, t is time, and h(t) is an impulse response representing transfer characteristics of the room. The symbol "*" represents a convolution operation, and $c_1$ and $c_2$ represent gain. Similarly, $c_3x(t)$ represents a direct wave reaching the microphone 16012 and $c_4h(t)*x(t)$ is a reflected wave reaching the microphone 16012. Let l(t) and r(t) represent respectively the signals picked up by the microphone 16011 and the microphone 16012, and l(t) and r(t) are linear sums of the direct wave and the reflected wave as below:

$$l(t)=c_1x(t)+c_2h(t)*x(t) \tag{1}$$

$$r(t)=c_3x(t)+c_4h(t)*x(t) \tag{2}$$

Since a HE-AAC v2 decoder cannot obtain a signal equivalent to the sound source x(t) illustrated in FIG. 16, a stereophonic signal is approximately derived from a monophonic signal s(t). The first term and the second term of the following equations (3) and (4) approximate a direct wave and a reflected wave (reverberation component), respectively:

$$l'(t)=c'_1s(t)+c'_2h'(t)*s(t) \tag{3}$$

$$r'(t)=c'_3s(t)+c'_4h'(t)*s(t) \tag{4}$$

A variety of production methods of the reverberation component are available. For example, a parametric stereophonic (hereinafter referred to as PS) decoder complying with the HE-AAC v2 standard decorrelates (orthogonalizes) a monophonic signal s(t) in order to generate a reverberation signal d(t) and generates a stereophonic signal in accordance with the following equations:

$$l'(t)=c'_1s(t)+c'_2d(t) \tag{5}$$

$$r'(t)=c'_3s(t)+c'_4d(t) \tag{6}$$

For convenience of explanation, the process described above is performed in the time domain. The PS decoder performs a pseudo-stereophonic operation in the time-frequency domain (quadrature mirror filter bank (QMF) coefficient domain). Equations (5) and (6) are thus represented by the following equations (7) and (8) respectively:

$$l'(b,t)=h_{11}s(b,t)+h_{12}d(b,t) \tag{7}$$

$$r'(b,t)=h_{21}s(b,t)+h_{22}d(b,t) \tag{8}$$

where b is an index representing frequency, and t is an index representing time.

A method of producing a reverberation signal d(b,t) from a monophonic signal s(b,t) is described below. A variety of techniques are available to generate the reverberation signal d(b,t). The PS decoder complying with the HE-AAC v2 standard decorrelates (orthogonalizes) the monophonic signal s(b,t) as illustrated in FIG. 17 into the reverberation signal d(b,t) using an infinite impulse response (IIR) type all-pass filter.

FIG. 18 illustrates a relationship of an input signal (L, R), a monophonic signal s, and a reverberation signal d. As illustrated in FIG. 18, let $\alpha$ represent an angle made between the monophonic signal s and each of the input signal S and the input signal R, and $\cos(2\alpha)$ is defined as a similarity. An HE-AAC v2 encoder encodes $\alpha$ as similarity information. The similarity information represents a similarity between the L channel input signal and the R channel input signal.

For simplicity of explanation, the lengths of L and R are equal to each other in FIG. 18. Considering the case in which the lengths (norms) of L and R are different from each other, the norm ratio of L to R is defined as an intensity difference. The encoder thus encodes the norm ratio as intensity difference information. The intensity difference information thus represents the power ratio of the L channel input signal to the R channel input signal.

A method of the decoder of generating a stereophonic signal from the monophonic signal s(b,t) and the reverberation signal d(b,t) is described below. Referring to FIG. 19, S represents a decoded input signal, D represents a reverberation signal obtained at the decoder, $C_l$ represents a scale factor of the L channel signal calculated from the intensity difference. A vector results from combining a result of projecting the monophonic signal scaled by $C_l$ at an angle of $\alpha$ and a result of projecting the reverberation signal scaled by $C_l$ at an angle of $(\pi/2-\alpha)$. The vector is thus set to be a decoded L channel signal. The process is expressed by equation (9). Similarly, the R channel signal is generated in accordance with equation (10) using a scale factor $C_r$, the decoded input signal S, the reverberation signal D, and the angle $\alpha$. $C_l$ and $C_r$ are related as $C_1+C_r=2$:

$$\begin{aligned} L'(b,t) &= C_ls(b,t)\cos\alpha + C_ld(b,t)\cos[\pi/2-\alpha] \\ &= C_ls(b,t)\cos\alpha + C_ld(b,t)\sin\alpha \end{aligned} \tag{9}$$

$$\begin{aligned} R'(b,t) &= C_rs(b,t)\cos(-\alpha) - C_rd(b,t)\cos[\pi/2-\alpha] \\ &= C_rs(b,t)\cos(-\alpha) + C_rd(b,t)\sin(-\alpha) \end{aligned} \tag{10}$$

Equations (9) and (10) are combined as equations (11) and (12):

$$\begin{bmatrix} L'(b,t) \\ R'(b,t) \end{bmatrix} = \begin{bmatrix} h_{11} & h_{12} \\ h_{21} & h_{22} \end{bmatrix} \begin{bmatrix} s(b,t) \\ d(b,t) \end{bmatrix} \tag{11}$$

$$H = \begin{bmatrix} h_{11} & h_{12} \\ h_{21} & h_{22} \end{bmatrix} \tag{12}$$

$$h_{11} = C_l\cos\alpha, \quad h_{12} = C_l\sin\alpha$$

$$h_{21} = C_r\cos(-\alpha), \quad h_{22} = C_r\sin(-\alpha)$$

A parametric stereophonic decoding apparatus operating on the above-described principle is described below. FIG. 20 illustrates a basic structure of the parametric stereophonic decoding apparatus. A data separator 2001 separates encoded core data and PS data from received input data.

A core decoder 2002 decodes the encoded core data and outputs a monophonic audio signal S(b,t). Here, b represents an index of a frequency band. The core decoder 2002 may be based on a known audio encoding and decoding technique such as an advanced audio coding (AAC) system or a spectral band replication (SBR) system.

The monophonic audio signal S(b,t) and the PS data are input to a parametric stereophonic (PS) decoder 2003. The PS decoder 2003 converts the monophonic audio signal S(b,t) into stereophonic decoded signals L(b,t) and R(b,t) in the frequency domain in accordance with the information of the PS data.

Frequency-time converters 2004(L) and 2004(R) convert an L channel frequency-domain decoded signal L(b,t) and an R channel frequency-domain decoded signal R(b,t) into an L channel time-domain decoded signal L(t) and an R channel time-domain decoded signal R(t), respectively.

FIG. 21 illustrates a structure of the PS decoder 2003 of FIG. 20 in the related art. Based on the principle discussed with reference to FIGS. 16-19, a delay adder 2101 adds a delay to the monophonic audio signal S(b,t) and a decorrelator 2102 decorrelates the delay-added monophonic audio signal S(b,t). A reverberation signal D(b,t) is thus generated.

A PS analyzer 2103 analyzes the PS data, thereby extracting a similarity and an intensity difference from the PS data. As previously discussed with reference to FIG. 18, the similarity is the similarity between the L channel signal and the R channel signal. The similarity is calculated from the L channel input signal and the R channel input signal and then quantized on the decoder. The intensity difference is a power ratio of the L channel signal to the R channel signal. The intensity difference is calculated and then quantized on the encoder.

A coefficient calculator 2104 calculates a coefficient matrix H from the similarity and the intensity difference in accordance with the above-described equation (12). A stereophonic signal generator 2105 generates the stereophonic signals L(b,t) and R(b,t) based on the monophonic audio signal S(b,t), the reverberation signal D(b,t), and the coefficient matrix H in accordance with the above-described equations (11) and (12). Time suffix t is omitted in FIG. 21 and equation (13):

$$L(b)=h_{11}S(b)+h_{12}D(b)$$

$$R(b)=h_{21}S(b)+h_{22}D(b) \tag{13}$$

In one case, the above-described parametric stereophonic system of the related art may receive audio signals having no substantial correlation between an L channel input signal and an R channel input signal, such as two different language voices in encoded form.

In the parametric stereophonic system, a stereophonic signal is generated from a monophonic signal S on a decoder side. As understood from the above-described equation (13), the property of the monophonic signal S affects the output signals L' and R'.

For example, if an original L channel input signal is completely different from an original R channel input signal (with the similarity being zero), the output audio signal from the PS decoder 2003 of FIG. 20 is calculated in accordance with equation (14):

$$L'(b)=h_{11}S(b)$$

$$R'(b)=h_{21}S(b) \tag{14}$$

In other words, a component of the monophonic signal S appears in the output signals L' and R'. FIG. 22 diagrammatically illustrates how the component of the monophonic signal S appears. The monophonic signal S is the sum of an L channel input signal L and an R channel input signal R. Equation (14) means that one signals leaks into the other channel.

The parametric stereophonic decoding apparatus of the related art emits similar sounds from the left and right if the output signals L' and R' are heard at the same time. The user may hear the similar sound as an echo, with the sound quality degraded.

SUMMARY

An audio decoding method includes: acquiring, from encoded audio data, a reception audio signal and first auxiliary decoded audio information; calculating coefficient information from the first auxiliary decoded audio information; generating a decoded output audio signal based on the coefficient information and the reception audio signal; decoding to result in a decoded audio signal based on the first auxiliary decoded audio signal and the reception audio signal; calculating, from the decoded audio signal, second auxiliary decoded audio information corresponding to the first auxiliary decoded audio information; detecting a distortion caused in a decoding operation of the decoded audio signal by comparing the second auxiliary decoded audio information with the first auxiliary decoded audio information; correcting the coefficient information in response to the detected distortion; and supplying the corrected coefficient information as the coefficient information when generating the decoded output audio signal.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DETAILED DESCRIPTION OF THE EMBODIMENTS

The best mode embodiments are described below with reference to the drawings.

First Embodiment

Figure 1:
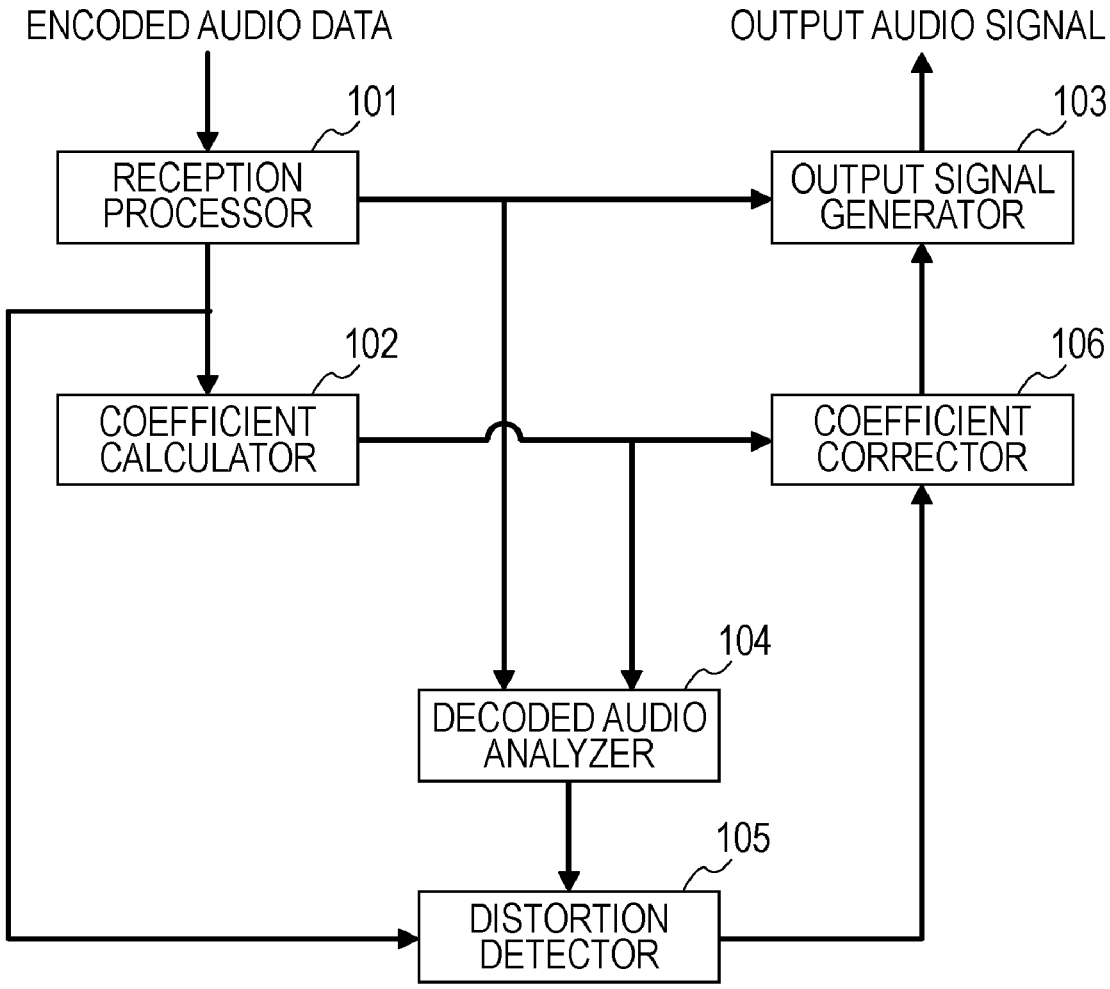
FIG. 1 illustrates a structure of a first embodiment.

FIG. 1 illustrates a structure of a first embodiment.

A reception processor 101 acquires, from encoded audio data, a reception audio signal and auxiliary decoded audio information. More specifically, the reception processor 101 acquires from parametric stereophonic encoded audio data a monophonic audio signal, a reverberation audio signal, and parametric stereophonic parameter information.

A coefficient calculator 102 calculates coefficient information from first auxiliary decoded audio information. More specifically, the coefficient calculator 102 acquires the coefficient information from the parametric stereophonic parameter information.

A decoded audio analyzer 104 decodes an audio signal to generate a decoded audio signal in accordance with the first auxiliary decoded audio information, and the reception audio signal, and calculates, from the decoded audio signal, second auxiliary decoded audio information corresponding to the first auxiliary decoded audio information. More specifically, the decoded audio analyzer 104 decodes the audio signal to generate the decoded audio signal in accordance with parametric stereophonic parameter information as first parametric stereophonic parameter information, a monophonic decoded audio signal, and a reverberation audio signal. The decoded audio analyzer 104 calculates, from the decoded audio signal, second parametric stereophonic parameter information corresponding to the first parametric stereophonic parameter information.

A distortion detector 105 detects distortion caused in the decoding process by comparing the second auxiliary decoded audio information with the first auxiliary decoded audio information. More specifically, the distortion detector 105 detects the distortion caused in the decoding process by comparing the second parametric stereophonic parameter information with the first parametric stereophonic parameter information.

A coefficient corrector 106 corrects the coefficient information in response to the distortion detected by the distortion detector 105, and supplies the corrected coefficient information to an output signal generator 103. The output signal generator 103 generates an output audio signal in a decoded form in response to the corrected coefficient information and the reception audio signal. More specifically, the output signal generator 103 generates an output stereophonic decoded audio signal based on the corrected coefficient information, the monophonic audio signal, and the reverberation audio signal.

In the above-described arrangement, the parametric stereophonic parameter information contains similarity information between stereophonic audio channels and intensity difference information indicating an intensity difference between signals of the stereophonic audio channels. The decoded audio analyzer 104 calculates second similarity information and second intensity difference information, corresponding to first similarity information, as the first parametric stereophonic parameter information, and first intensity difference information, respectively.

The distortion detector 105 compares the second similarity information and the second intensity difference information with the first similarity information and the first intensity difference information, respectively, for each frequency band. The distortion detector 105 thus detects distortion, caused in the decoding process, and an audio channel causing the distortion for each frequency band and for each stereophonic audio channel.

The coefficient corrector 106 corrects the coefficient information of the audio channel detected by the distortion detector 105 in response to the distortion detected by the distortion detector 105 for each frequency band and for each stereophonic audio channel.

A pseudo-stereophonic operation or the like is performed on a monophonic decoded audio signal in accordance with the first parametric stereophonic parameter information. A stereophonic decoded audio signal is thus produced. In such a system, the second parametric stereophonic parameter information corresponding to the first parametric stereophonic parameter information is generated from the stereophonic decoded audio signal. The first parametric stereophonic parameter information is thus compared with the second parametric stereophonic parameter information in order to detect the distortion in the decoding process for the pseudo-stereophonic operation.

A coefficient correction operation to remove echoing may be applied to the stereophonic decoded audio signal. Sound degradation on the decoded audio signal is thus controlled.

Second Embodiment

Figure 2:
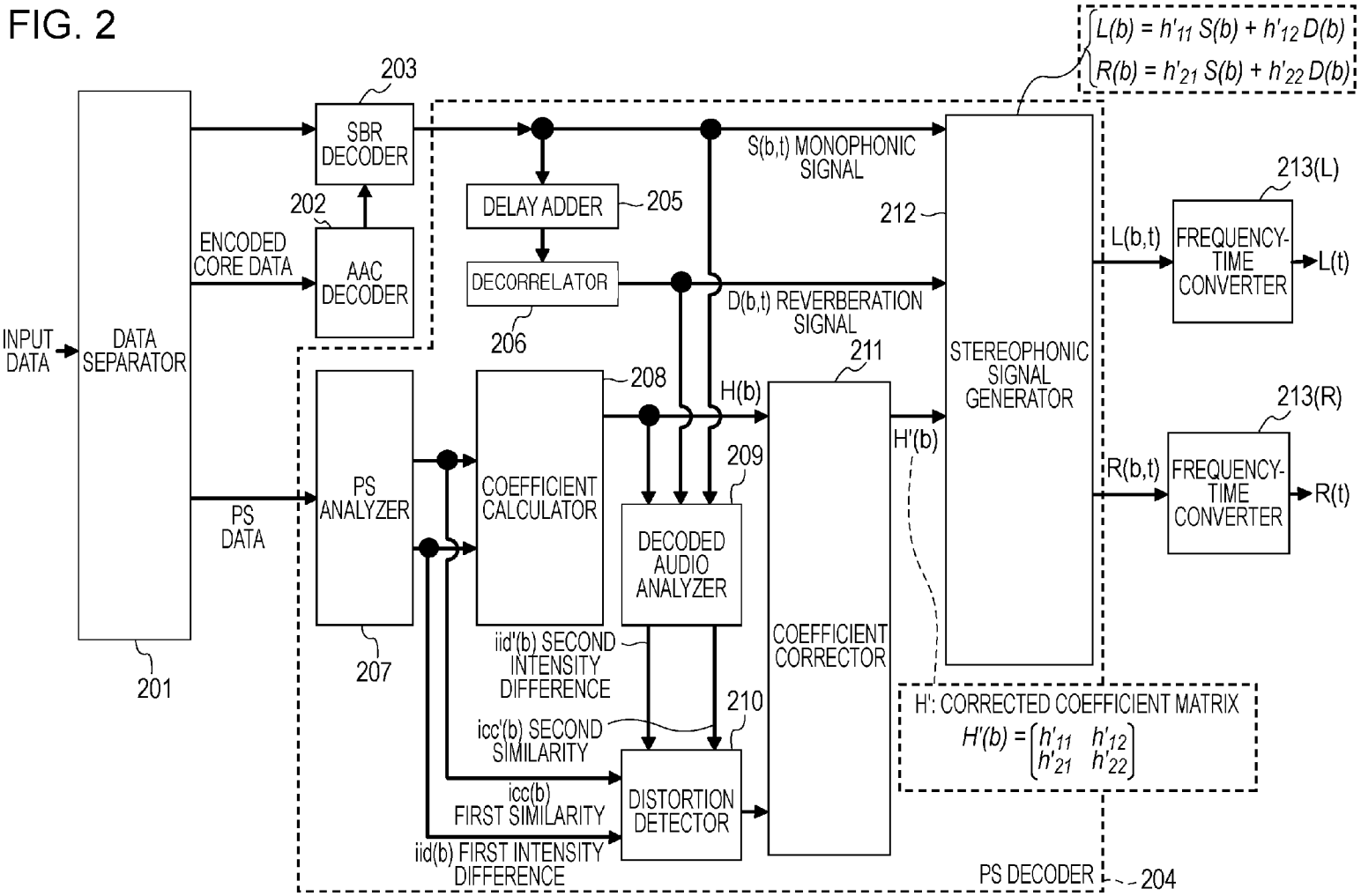
FIG. 2 illustrates a structure of a second embodiment.
Figure 3:
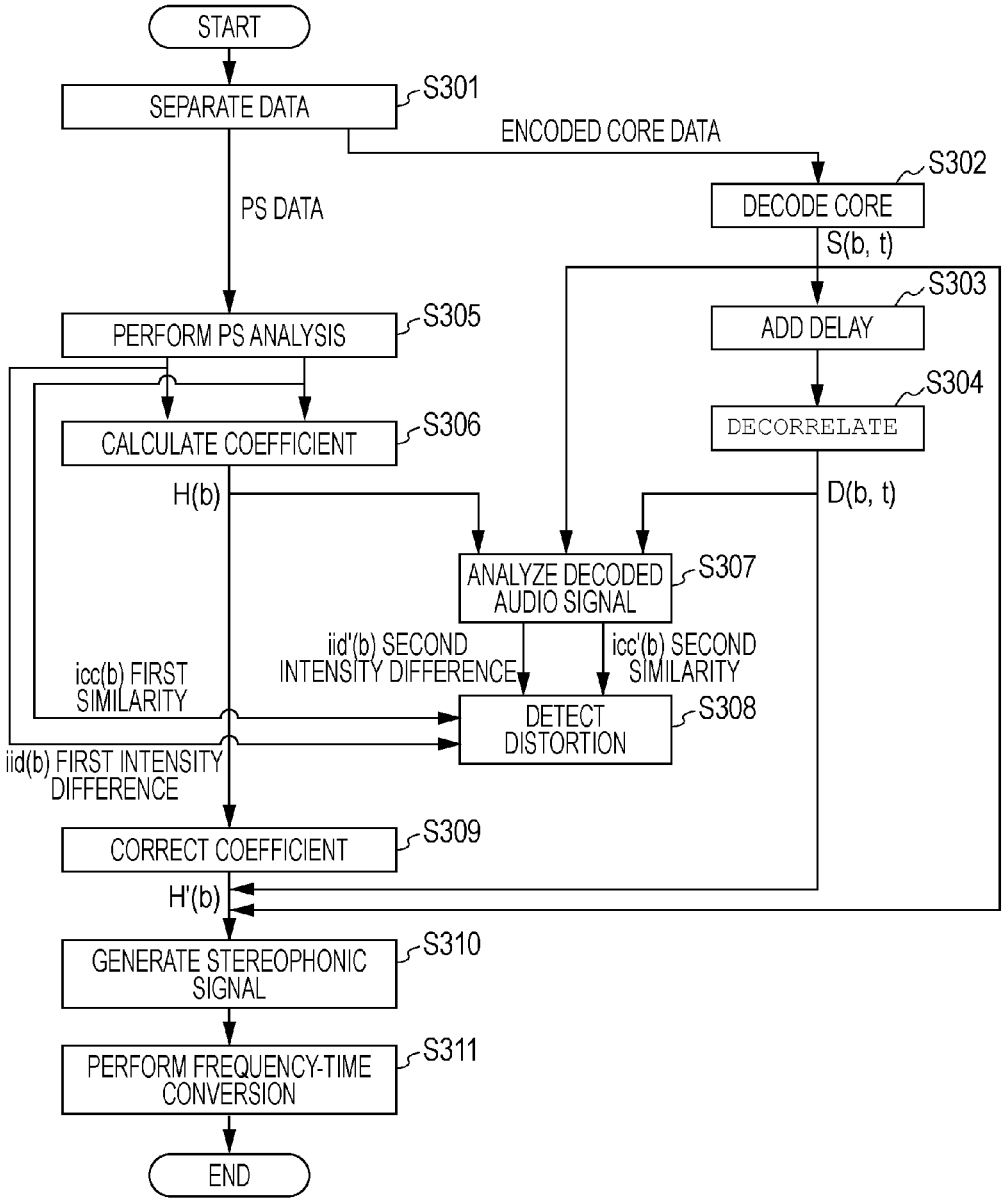
FIG. 3 is a flowchart illustrating an operation of the second embodiment.

FIG. 2 illustrates a structure of a parametric stereophonic decoding apparatus of a second embodiment. FIG. 3 is a flowchart illustrating an operation of the second embodiment. In the discussion that follows, elements 201-213 in FIG. 2 and steps S301-S311 in FIG. 3 are referenced as appropriate.

A data separator 201, a SBR decoder 203, an AAC decoder 202, a delay adder 205, a decorrelator 206, and a parametric stereophonic (PS) analyzer 207 in FIG. 2 correspond to the reception processor 101 illustrated in FIG. 1. A coefficient calculator 208 illustrated in FIG. 2 corresponds to the coefficient calculator 102 illustrated in FIG. 1. A stereophonic signal generator 212 illustrated in FIG. 2 corresponds to the output signal generator 103 illustrated in FIG. 1. A decoded audio analyzer 209 illustrated in FIG. 2 corresponds to the decoded audio analyzer 104 illustrated in FIG. 1. A distortion detector 210 illustrated in FIG. 2 corresponds to the distortion detector 105 illustrated in FIG. 1. A coefficient corrector 211 illustrated in FIG. 2 corresponds to the coefficient corrector 106 illustrated in FIG. 1.

The data separator 201 illustrated in FIG. 2 separates encoded core data and parametric stereophonic (PS) data from received input data (step S301 in FIG. 3).

The AAC decoder 202 illustrated in FIG. 2 decodes an audio signal, encoded through the advanced audio coding (AAC) system, from the encoded core data input from the data separator 201. Moreover, the SBR decoder 203 decodes an audio signal, encoded through the spectral band replication (SBR) system, from the audio signal decoded by the AAC decoder 202, and then outputs a monophonic audio signal S(b,t) (step S302 illustrated in FIG. 3). Here, b represents an index of a frequency band.

The monophonic audio signal S(b,t) and the PS data are input to the parametric stereophonic (PS) decoder 204. The PS decoder 204 illustrated in FIG. 2 operates based on the principle described with reference to FIGS. 16-19. More specifically, the delay adder 205 adds a delay to the monophonic audio signal S(b,t) (step S303 illustrated in FIG. 3), the decorrelator 206 decorrelates the output of the delay adder 205 (step S304 illustrated in FIG. 3), and the reverberation signal D(b,t) is generated.

The parametric stereophonic (PS) analyzer 207 illustrated in FIG. 2 extracts, from the PS data input from the data separator 201, a first similarity icc(b) and a first intensity difference iid(b) (step S305 illustrated in FIG. 3). As previously discussed with reference to FIG. 18, the first similarity icc(b) indicates a similarity between an L channel signal and an R channel signal (e.g., a value that is calculated from an L channel input signal and an R channel input signal and then quantized by an encoder side). The first intensity difference iid(b) indicates a power ratio of the L channel signal to the R channel signal (e.g., a value that is calculated from the L channel input signal and the R channel input signal and then quantized by the encoder side).

The coefficient calculator 208 illustrated in FIG. 2 calculates a coefficient matrix H(b) from the first similarity icc(b) and the first intensity difference iid(b) (step S306 illustrated in FIG. 3). The decoded audio analyzer 209 illustrated in FIG. 2 decodes and analyzes the decoded audio signal based on the monophonic audio signal S(b,t) output from the SBR decoder 203, the reverberation signal D(b,t) output from the decorrelator 206, and the coefficient matrix H(b) output from the coefficient calculator 208, thereby calculating a second similarity icc'(b), and a second intensity difference iid'(b) (step S307 illustrated in FIG. 3).

The distortion detector 210 illustrated in FIG. 2 compares the second similarity icc'(b) and the second intensity difference iid'(b), calculated on the decoder side, with the first similarity icc(b) and the first intensity difference iid(b), calculated by and transferred from the encoder side. The distortion detector 210 thus calculates a distortion added in the course of the parametric stereophonic operation (step S308 illustrated in FIG. 3).

The coefficient corrector 211 illustrated in FIG. 2 corrects the coefficient matrix H(b) output from the coefficient calculator 208 in accordance with distortion data detected by the distortion detector 210, and outputs a corrected coefficient matrix H'(b) (step S309 illustrated in FIG. 3).

The stereophonic signal generator 212 generates stereophonic signals L(b,t) and R(b,t) based on the monophonic audio signal S(b,t), the reverberation signal D(b,t), and the corrected coefficient matrix H'(b) (step S310 illustrated in FIG. 3).

Frequency-time converters 213(L) and 213(R) convert an L channel frequency-domain decoded signal and an R channel frequency-domain decoded signal, spectrum corrected in accordance with the corrected coefficient matrix H'(b), into an L channel time-domain decoded signal L(t) and an R channel time-domain decoded signal R(t), and then outputs the L channel time-domain decoded signal L(t) and the R channel time-domain decoded signal R(t) (step S311 illustrated in FIG. 3).

Figure 4A:
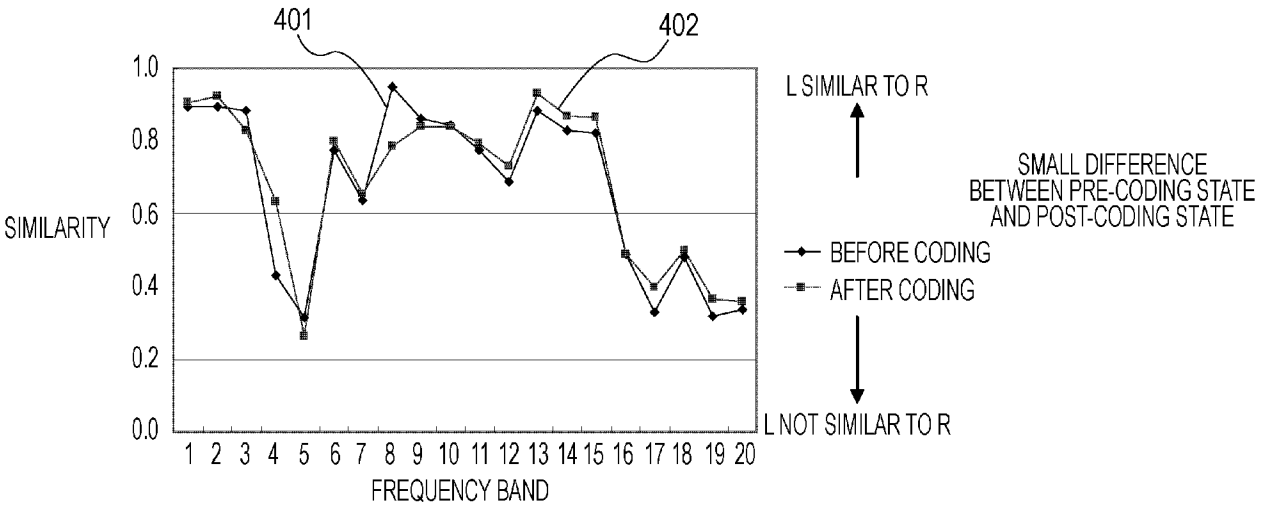
FIGS. 4A and 4B illustrate an operation of a parametric stereophonic decoding apparatus as one embodiment.

The input stereophonic sound may be jazz, which is typically free from echoing, as illustrated in FIG. 4A. In such a case, a difference between a similarity 401 prior to encoding (e.g., a similarity calculated on an encoding apparatus) and a similarity 402 subsequent to encoding (e.g., a similarity calculated from a parametric stereophonic decoded sound on a decoding apparatus), when compared for each frequency band, is small in accordance with the second embodiment. Since a similarity between original sounds at the L channel and the R channel is high prior to encoding in the jazz sound illustrated in FIG. 4A, the parametric stereophonic operation works excellently. The similarity between the pseudo-stereophonic signals at L channel and the R channel decoded from the monophonic audio signal S(b,t) transferred and then decoded is high. As a result, the difference between the similarities is small.

Figure 4B:
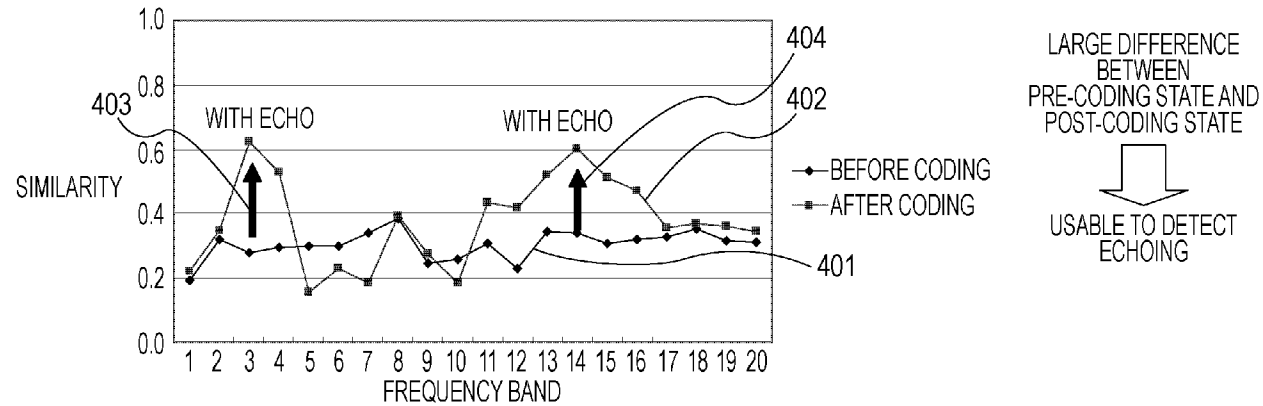

The input stereophonic sound may be two languages (for example, L channel: German, and R channel: Japanese) with echoing as illustrated in FIG. 4B. In such a case, a difference between the pre-encoding similarity 401 and the post-encoding similarity 402, when compared in each frequency band, becomes large in a given frequency band (portions labeled 403 and 404 in FIG. 4B). In the case of the bi-lingual sound as illustrated in FIG. 4B, a similarity between the L channel and the R channel in an original input sound is low. In the parametric stereophonic decoded sound, a pseudo stereophonic sound is decoded from the monophonic audio signal S(b,t) transmitted via the L channel and the R channel, and the similarity between the L channel and the R channel becomes high. As a result, the difference between the pre-encoding similarity 401 and the post-encoding similarity 402 becomes large. This means that the parametric stereophonic process fails to function properly.

In accordance with the second embodiment illustrated in FIG. 2, the distortion detector 210 detects the distortion by comparing the first similarity icc(b) extracted from the transmitted input data, and the second similarity icc'(b) calculated from the decoded sound by the decoded audio analyzer 209. Furthermore, the distortion detector 210 evaluates the difference between the first intensity difference iid(b) extracted from the transmitted input data and the second intensity difference iid'(b) re-calculated from the decoded sound by the decoded audio analyzer 209 to determine whether the L channel or the R channel is to be corrected. In response to the process result, the coefficient corrector 211 corrects the coefficient matrix H(b) in response to the frequency index b, thereby calculating the corrected coefficient matrix H'(b).

Figures 5A, 5B, 5C:
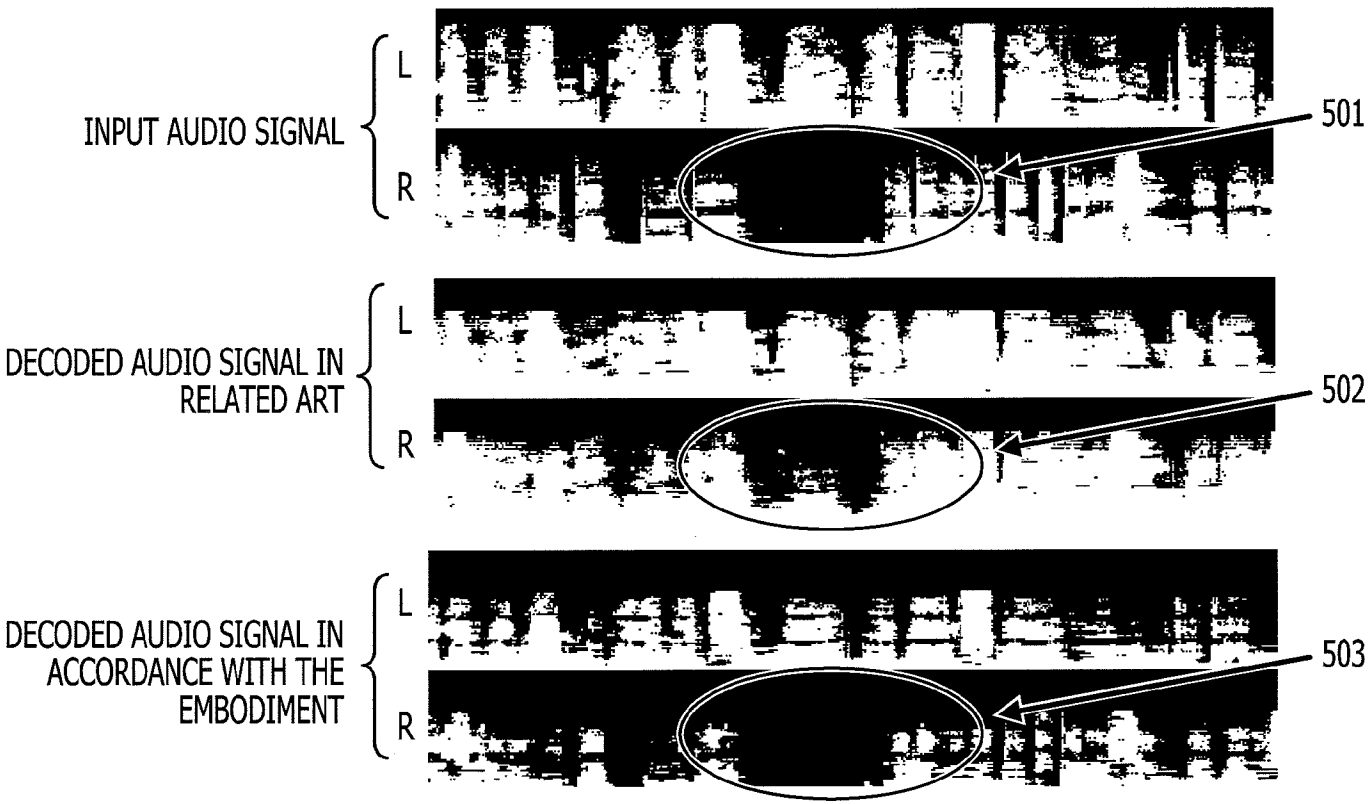
FIGS. 5A-5C illustrate the advantages of the parametric stereophonic decoding apparatus of the embodiment.

If the input stereophonic sound is two languages (for example, L channel: German, and R channel: Japanese) as illustrated in FIG. 5A, a difference in audio components between the L channel and the R channel in the frequency band labeled 501 becomes large. In the decoded sound in the related art as illustrated in FIG. 5B, an audio component in the L channel leaks into the R channel in the frequency band labeled 502, corresponding to the input audio sound 501. If both the L and R channels are heard concurrently, the leaked sound sounds like an echo. On the other hand, in the decoded sound illustrated in FIG. 5C, the parametric stereophonic process suitably controls the distortion component leaked into the R channel in the frequency band 502 corresponding to the input audio sound 501. As a result, the echoing heard at the same time from the L channel and the R channel is reduced. No substantial degradation is felt in the sound in subjective tests.

The decoded audio analyzer 209, the distortion detector 210, and the coefficient corrector 211 illustrated in FIG. 2 performing the above-described process are described in detail below. Stereophonic input signals before being encoded by an encoding apparatus (not shown) are represented by an L channel signal L(b,t) and an R channel signal R(b,t). Here, b represents an index indicating a frequency band, and t represents an index indicating discrete time.

Figure 6:
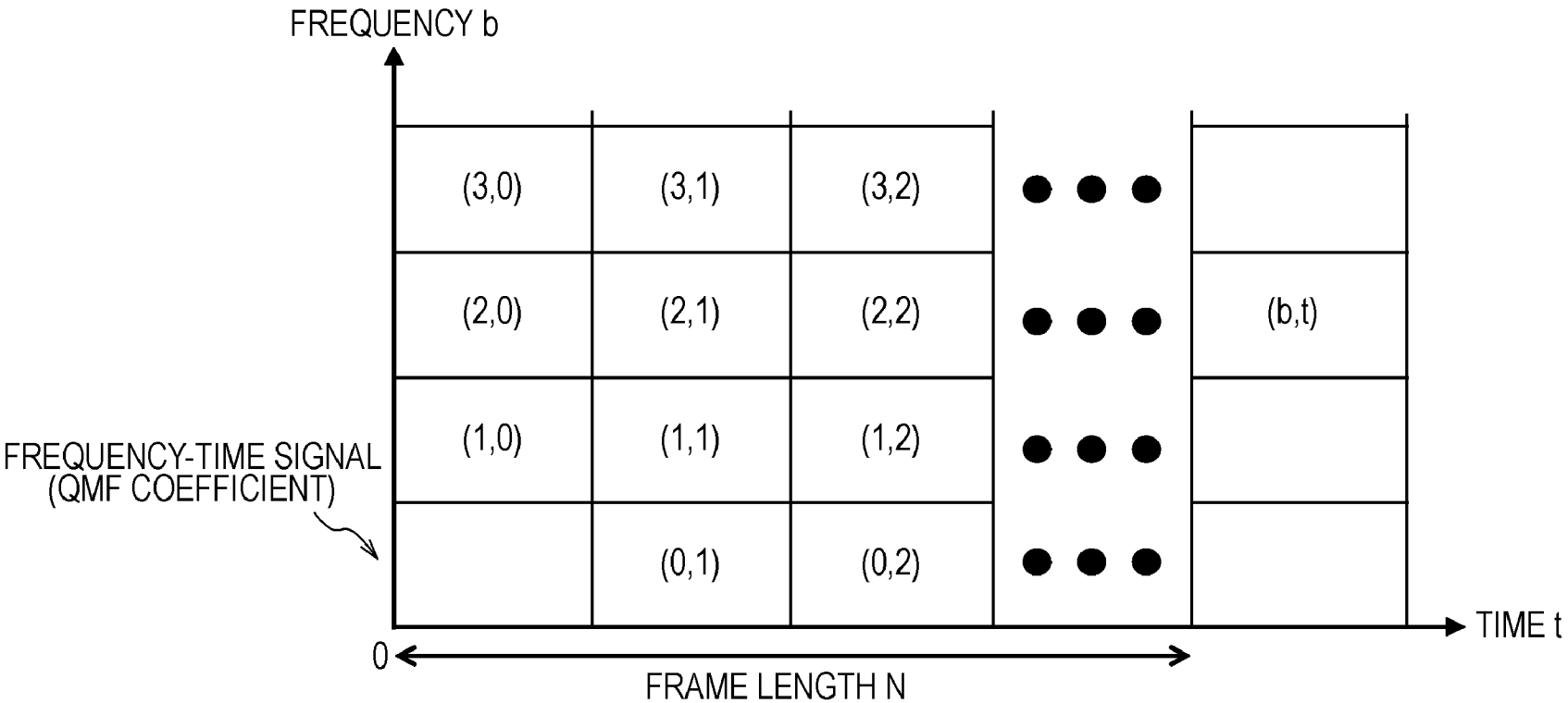
FIG. 6 illustrates the definition of time and frequency signals in an HE-AAC decoder.

FIG. 6 illustrates the definition of a time-frequency signal in an HE-AAC decoder. Each of the signals L(b,t) and R(b,t) contains a plurality of signal components segmented by a frequency band b every discrete time t. One time-frequency signal (corresponding to quadrature mirror filter bank (QMF) coefficient) is represented by L(b,t) or R(b,t) using b and t.

The first intensity difference iid(b) and the first similarity icc(b) at a frequency band b, transmitted from a parametric stereophonic encoding apparatus and then extracted by a parametric stereophonic decoding apparatus, are calculated in accordance with the following equations (15):

$$iid(b) = 10\log_{10}\frac{e_L(b)}{e_R(b)} \tag{15}$$

$$icc(b) = \frac{\mathrm{Re}\{e_{LR}(b)\}}{\sqrt{e_L(b)e_R(b)}}$$

where $$e_L(b) = \sum_{t=0}^{N-1} L^*(b,t)L(b,t)$$

$$e_R(b) = \sum_{t=0}^{N-1} R^*(b,t)R(b,t)$$

$$e_{LR}(b) = \sum_{t=0}^{N-1} L(b,t)R^*(b,t)$$

where N represents a frame length (see FIG. 6) in the time direction.

From the equations (15), the first intensity difference iid(b) is the logarithm of the power ratio of the mean power $e_L(b)$ at the L channel signal L(b,t) to the mean power $e_R(b)$ at the R channel signal R(b,t) at a current frame ($0 \leqq t \leqq N-1$) at the frequency band b, and the first similarity icc(b) is a correlation between the L channel signal L(b,t) and the R channel signal R(b,t).

Figure 7A:
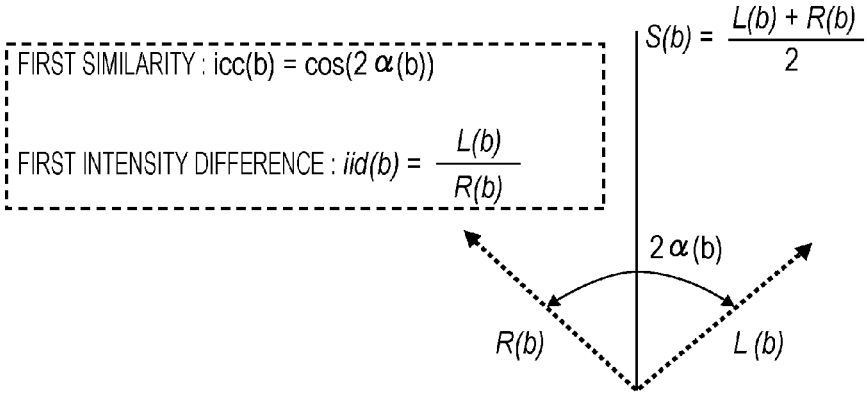
FIGS. 7A-7C illustrate a distortion detection and coefficient correction operation.
Figure 18:
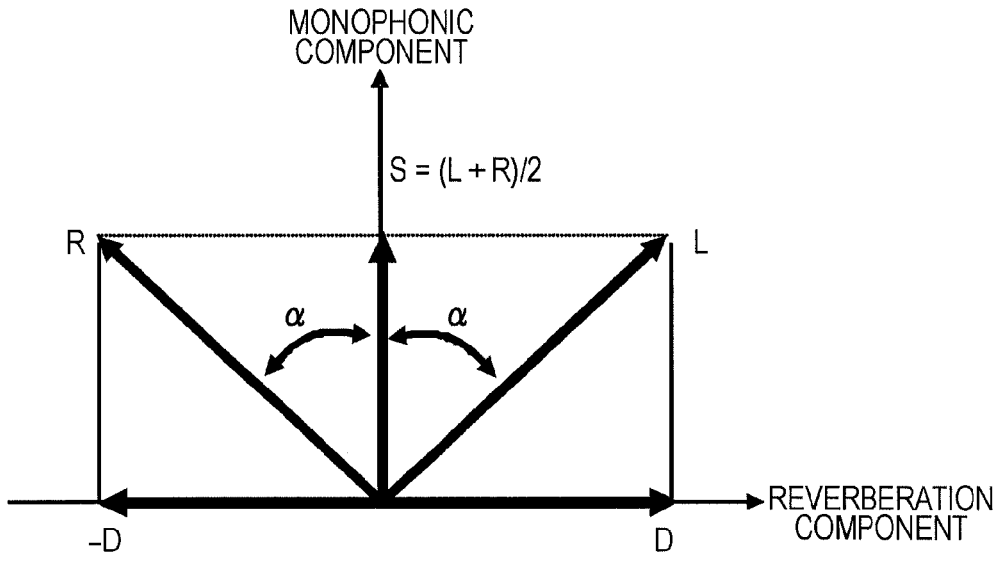
FIG. 18 RELATED ART
FIG. 18 illustrates a relationship of an input signal, a monophonic signal, and a reverberation signal.
Figure 19:
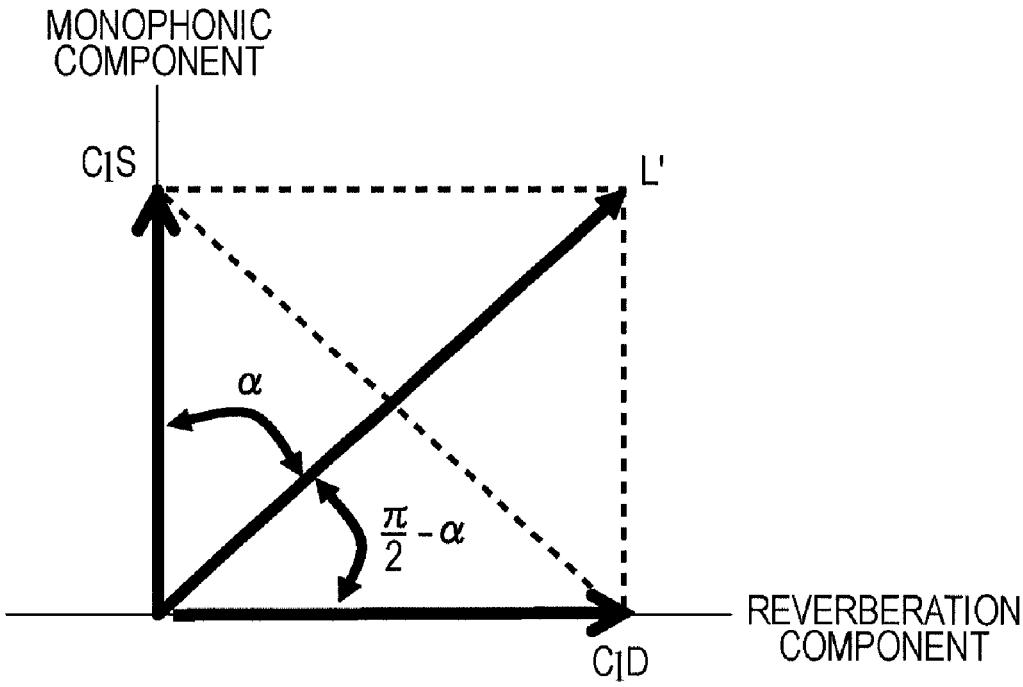
FIG. 19 RELATED ART
FIG. 19 illustrates a generation method of the stereophonic signal from the monophonic audio signal and the reverberation signal.
Figure 20:
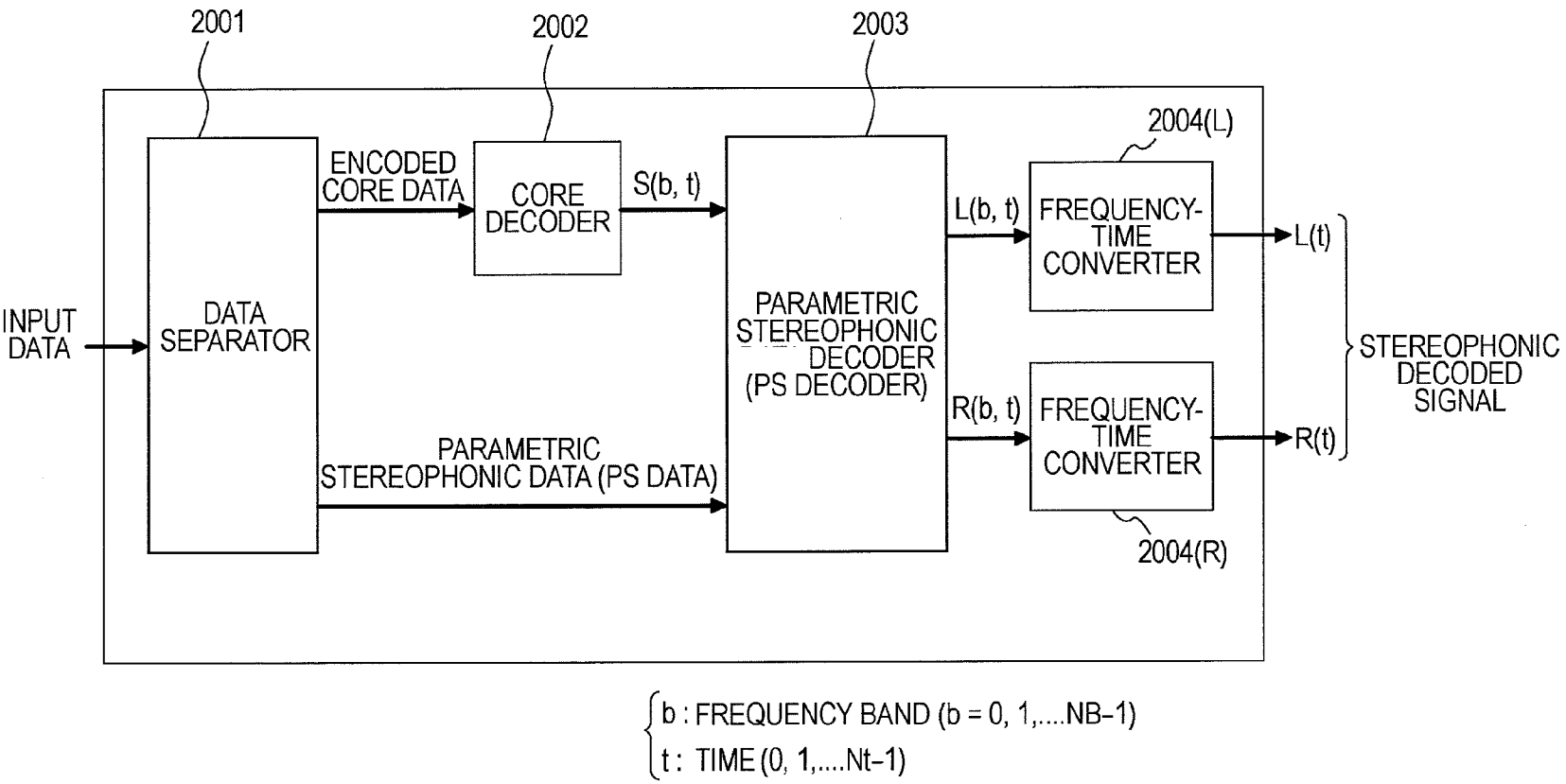
FIG. 20 RELATED ART
FIG. 20 illustrates a basic structure of the parametric stereophonic decoding apparatus.
Figure 21:
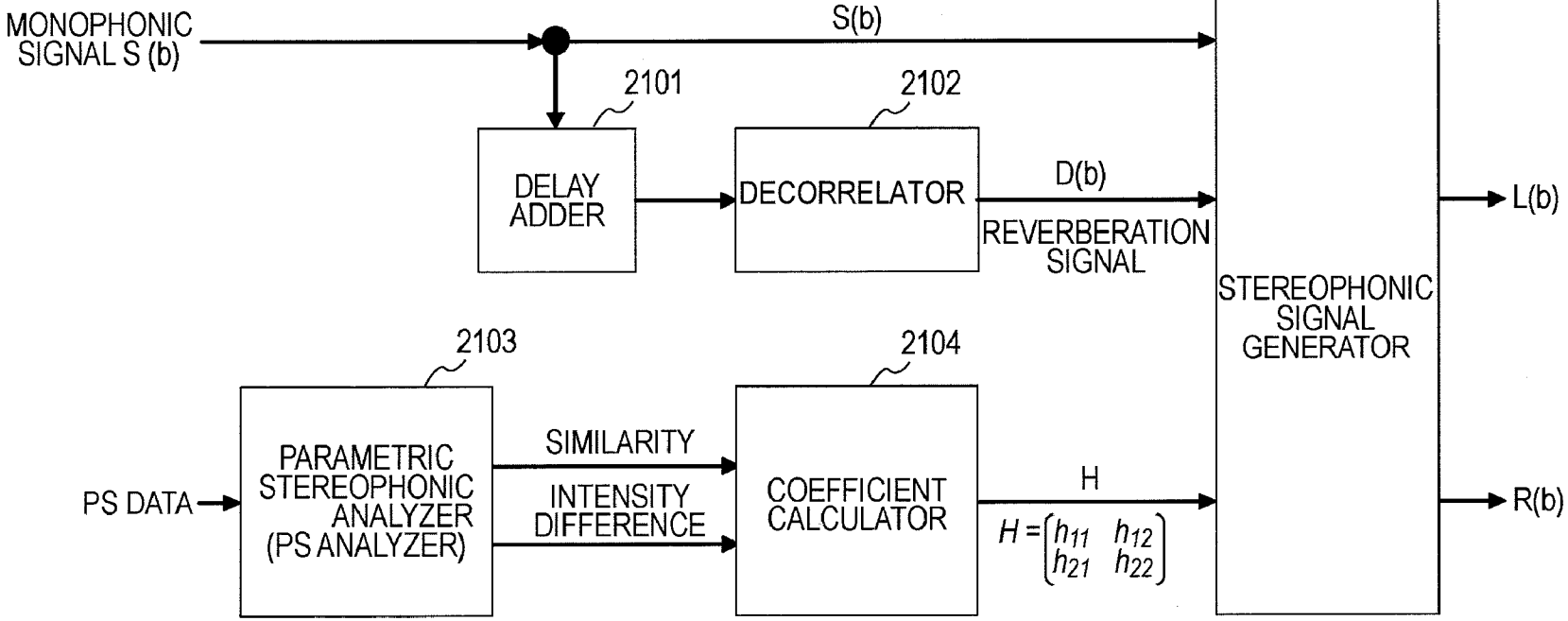
FIG. 21 RELATED ART
FIG. 21 illustrates a PS decoder of FIG. 20 in the related art.
Figure 22:
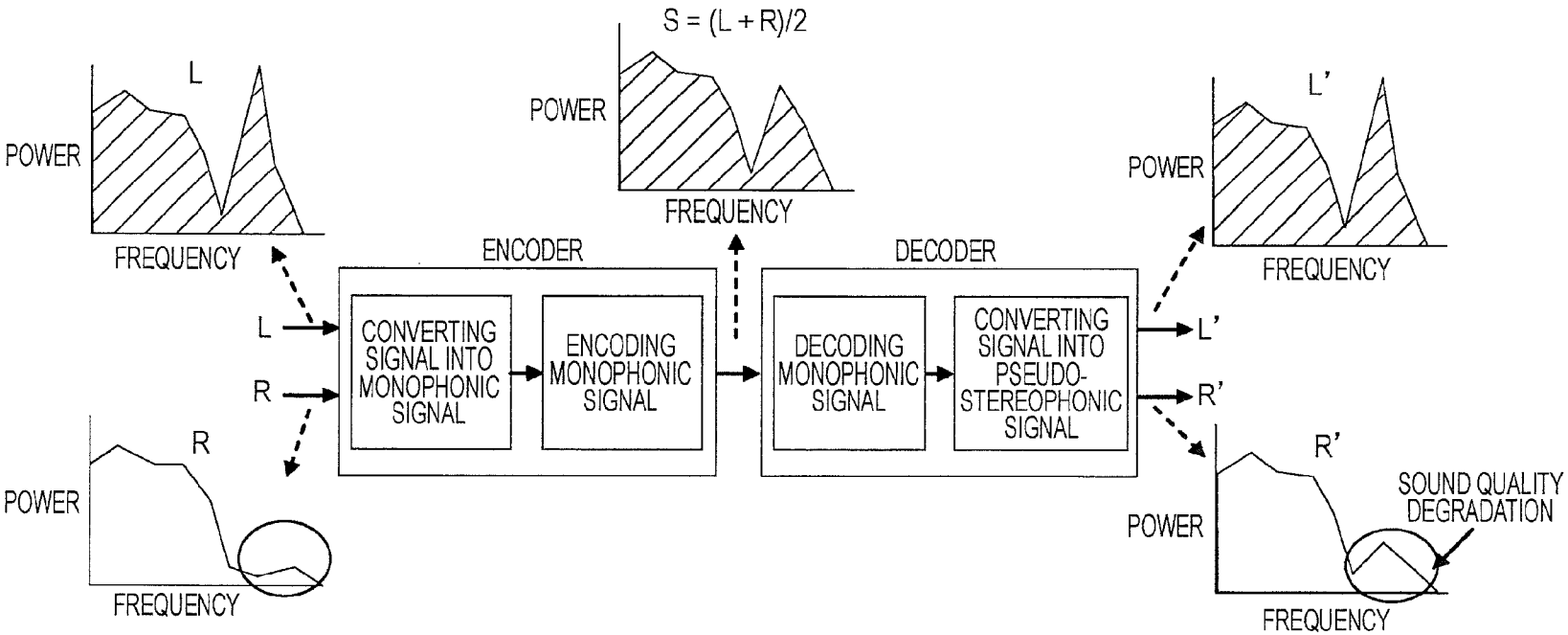
FIG. 22 RELATED ART
FIG. 22 illustrates a problem of the related art.

The relationship illustrated in FIG. 18 allows the L channel signal L(b,t), the R channel signal R(b,t), the first similarity icc(b), and the first intensity difference iid(b) to be related as illustrated in FIG. 7A. More specifically, the L channel signal L(b,t) and the R channel signal R(b,t) both make an angle $\alpha$ ($=\alpha(b)$) to the monophonic audio signal S(b,t) obtained on the parametric stereophonic decoding apparatus, and $\cos(2\alpha)$ is defined as the first similarity icc(b). The following equation (16) thus holds:

$$icc(b)=\cos(2\alpha) \tag{16}$$

Figure 7B:
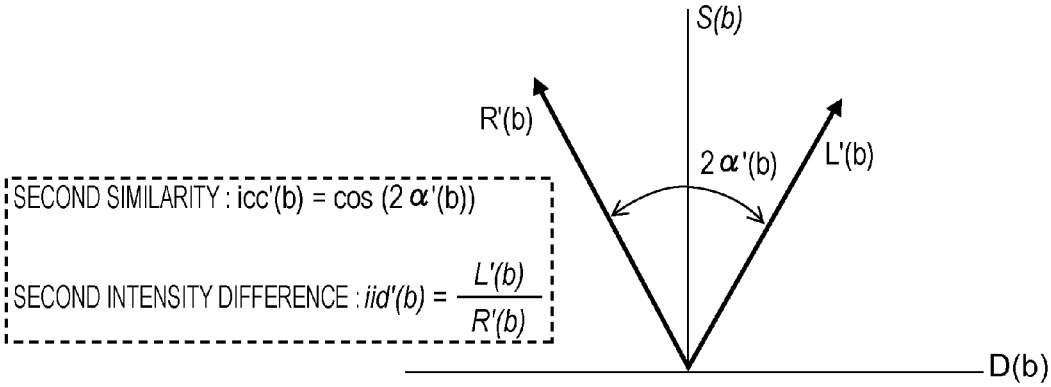
Figure 7C:
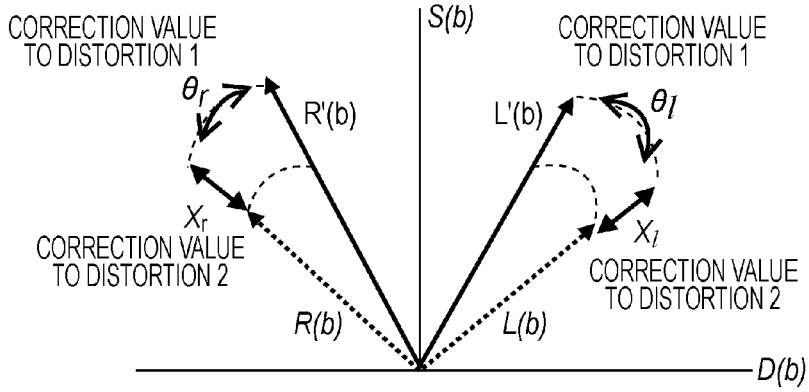

The norm ratio of the L channel signal L(b,t) to the R channel signal R(b,t) is defined as the first intensity difference iid(b). As illustrated in FIGS. 7A-7C, the time suffix t is omitted.

The coefficient calculator 208 illustrated in FIG. 2 may calculate the coefficient matrix H(b) in accordance with the above-described equation (12). In equation (12), the angle $\alpha$ is calculated based on the first similarity icc(b) calculated in accordance with equation (16) and output from the PS analyzer 207 illustrated in FIG. 2 in accordance with the following equation (17):

$$\alpha=1/2\ \arccos(icc(b)) \tag{17}$$

Scale factors $C_l$ and $C_r$ in equation (12) are calculated based on the first intensity difference iid(b) output from the PS analyzer 207 illustrated in FIG. 2 in accordance with the following equation (18):

$$C_l = \frac{\sqrt{2}}{1+c(b)^2},\ C_r = \frac{\sqrt{2}\,c(b)}{1+c(b)^2},\ c = 10^{\frac{iid(b)}{20}} \tag{18}$$

The decoded audio analyzer 209 illustrated in FIG. 2 performs equation (11) based on the monophonic audio signal S(b,t) output from the SBR decoder 203, the reverberation signal D(b,t) output from the decorrelator 206, and the coefficient matrix H(b) output from the coefficient calculator 208. A decoded L channel signal L'(b,t) and a decoded R channel signal R'(b,t) thus result.

The decoded audio analyzer 209 calculates the second intensity difference iid'(b) and the second similarity icc'(b) at the frequency band b in accordance with the following equations (19), based on the decoded L channel signal L'(b,t) and the decoded R channel signal R'(b,t) as in the same manner as with equations (15):

$$iid'(b) = 10\log_{10}\frac{e_{L'}(b)}{e_{R'}(b)} \tag{19}$$

$$icc'(b) = \frac{\mathrm{Re}\{e_{L'R'}(b)\}}{\sqrt{e_{L'}(b)e_{R'}(b)}}$$

where $$e_{L'}(b) = \sum_{t=0}^{N-1} L'^*(b,t)L'(b,t)$$

$$e_{R'}(b) = \sum_{t=0}^{N-1} R'^*(b,t)R'(b,t)$$

$$e_{L'R'}(b) = \sum_{t=0}^{N-1} L'(b,t)R'^*(b,t)$$

In the same manner as with equations (15), the relationship illustrated in FIG. 18 allows the decoded L channel signal L'(b,t), the decoded R channel signal R'(b,t), the second similarity icc'(b), and the second intensity difference iid'(b) to be related as illustrated in FIG. 7B. More specifically, each of the decoded L channel signal L'(b,t) and the decoded R channel signal R'(b,t) makes an angle $\alpha'$ to the monophonic audio signal S(b,t) obtained on the parametric stereophonic decoding apparatus, and $\cos(2\alpha')$ is defined as the second similarity icc'(b). The following equation (20) thus holds:

$$icc'(b)=\cos(2\alpha') \tag{20}$$

The norm ratio of the decoded L channel signal L'(b,t) to the decoded R channel signal R'(b,t) is defined as the second intensity difference iid'(b).

The L channel signal L(b,t), the R channel signal R(b,t), the first similarity icc(b), and the first intensity difference iid(b), prior to the parametric stereophonic operation, are related to each other as illustrated in FIG. 7A. The decoded L channel signal L'(b,t), the decoded R channel signal R'(b,t), the second similarity icc'(b), and the second intensity difference iid'(b), obtained subsequent to the parametric stereophonic operation, are related as illustrated in FIG. 7B. The two relationships illustrated in FIGS. 7A and 7B are combined as illustrated in FIG. 7C. Time suffix t is omitted in FIGS. 7A-7C. Referring to FIG. 7C, the channel signals have the relationship described below on a coordinate plane defined by the monophonic audio signal S(b,t) and the reverberation signal D(b,t) subsequent to the parametric stereophonic operation.

(1) The L channel signal L(b,t) and the decoded L channel signal L'(b,t) are different from each other by an angle of $\theta_l$ related to a difference between angles $\alpha$ and $\alpha'$. The R channel signal R(b,t) and the decoded R channel signal R'(b,t) are different from each other by an angle of $\theta_r$ related to the difference between the angles $\alpha$ and $\alpha'$. Let a distortion 1 represent the difference. In practice, the assumption of the distortion 1$=\theta=\theta_l=\theta_r$ holds without any problem.

(2) The L channel signal L(b,t) and the decoded L channel signal L'(b,t) are different from each other by an amplitude $X_l$. The R channel signal R(b,t) and the decoded R channel signal R'(b,t) are also different from each other by an amplitude $X_r$. Let a distortion 2 represent the difference. In practice, the assumption of the distortion 2$=X=X_l=X_r$ holds without any problem.

From the above understanding, the distortion detector 210 illustrated in FIG. 2 detects, in every frequency band b, the distortion 1$=\theta$ from the first similarity icc(b) and the second similarity icc'(b), and detects, in every frequency band b, the distortion 2=X from the first intensity difference iid(b) and the second intensity difference iid'(b). Next, the coefficient corrector 211 corrects the coefficient matrix H(b) output from the coefficient calculator 208 every frequency band b in accordance with the distortion 1$=\theta$ and the distortion 2=X, calculated by the distortion detector 210, thereby generating the corrected coefficient matrix H'(b). The stereophonic signal generator 212 decodes, in every frequency band b, the L channel signal L(b,t) and the R channel signal R(b,t) in accordance with the monophonic audio signal S(b,t) and the reverberation signal D(b,t) based on the corrected coefficient matrix H'(b) generated by the coefficient corrector 211. Since the distortion 1$=\theta=\theta_l=\theta_r$ and the distortion 2$=X=X_l=X_r$ are corrected in these signals illustrated in FIG. 7C, the original L channel signal and the original R channel signal prior to the parametric stereophonic operation are suitably reproduced.

Figure 8A:
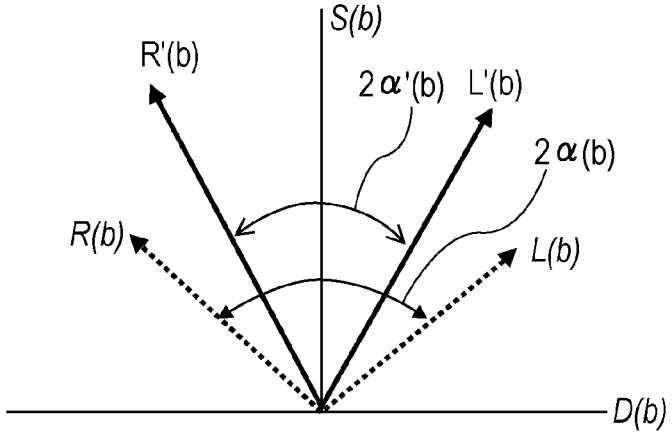
FIGS. 8A-8C illustrate a distortion detection and coefficient correction operation.

A specific detection method of the distortion detector 210 detecting the distortion 1$=\theta$ is described below. The angle $\alpha'$ (see FIG. 8A) represented in equation (20) is calculated using the second similarity icc'(b) at the frequency band b calculated by the decoded audio analyzer 209 in accordance with the following equation (21):

$$\alpha'=1/2\ \arccos(icc'(b)) \tag{21}$$

The angle $\alpha$ (see FIG. 8A) is calculated in accordance with equation (17) using the first similarity icc(b) at the frequency band b calculated by the PS analyzer 207.

Figure 8B:
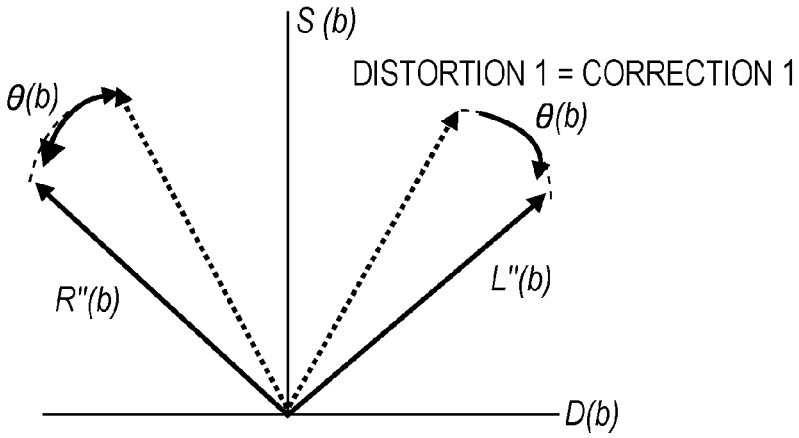

The distortion 1$=\theta$ ($=\theta$(b)) at the frequency band b (see FIG. 8B) is calculated in accordance with the following equation (22) in view of equations (21) and (17):

$$\theta=\alpha-\alpha'=1/2\{\arccos(icc(b))-\arccos(icc'(b))\} \tag{22}$$

More specifically, the distortion detector 210 performs equation (22) based on the first similarity icc(b) at the frequency band b calculated by the PS analyzer 207, and the second similarity icc'(b) at the frequency band b calculated by the decoded audio analyzer 209. As a result, the distortion 1$=\theta(=\theta(b))$ at the frequency band b is calculated.

The distortion 1$=\theta$ may also be calculated in the manner described below. The distortion detector 210 calculates a difference A(b) between the similarities at the frequency band b from the first similarity icc(b) and the second similarity icc'(b) at the frequency band b in accordance with the following equation (23):

$$A(b)=icc'(b)-icc(b) \tag{23}$$

Figure 8C:
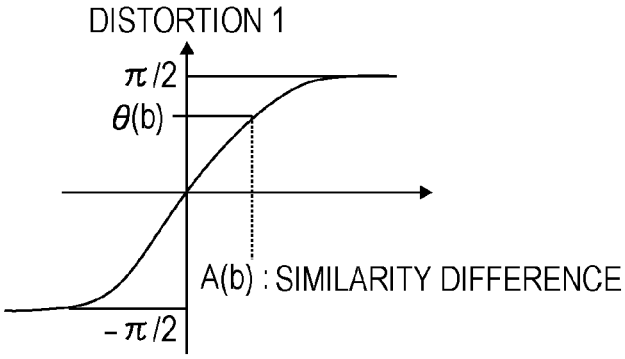

The distortion detector 210 calculates the distortion 1$=\theta=\theta$(b) for the similarity difference A(b) calculated in accordance with equation (23) based on a conversion table relating to a pre-calculated similarity difference to the distortion 1. The distortion detector 210 continuously stores a graph (relationship) on which the conversion table is based as illustrated in FIG. 8C.

Figure 9A:
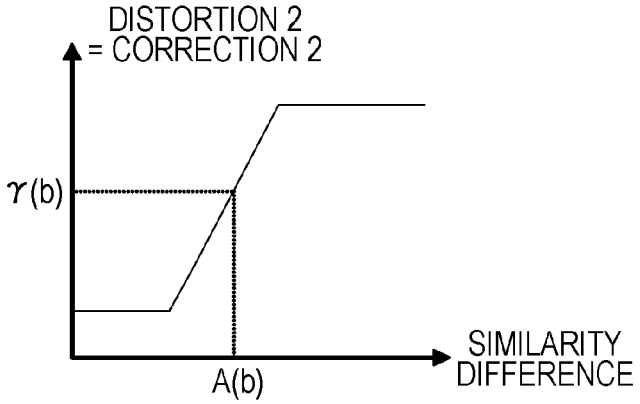
FIGS. 9A-9C illustrate a distortion detection and coefficient correction operation.
Figure 9B:
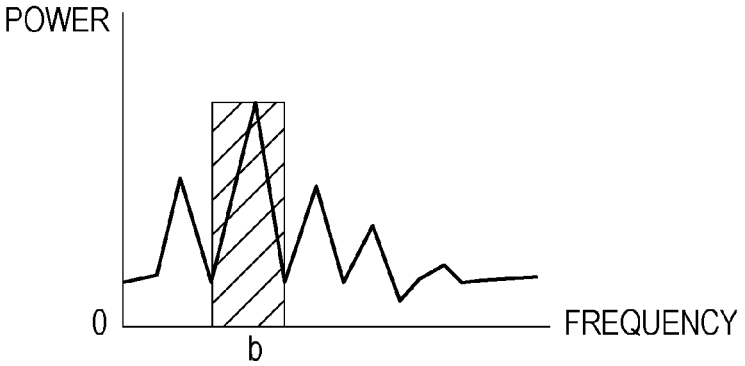
Figure 9C:
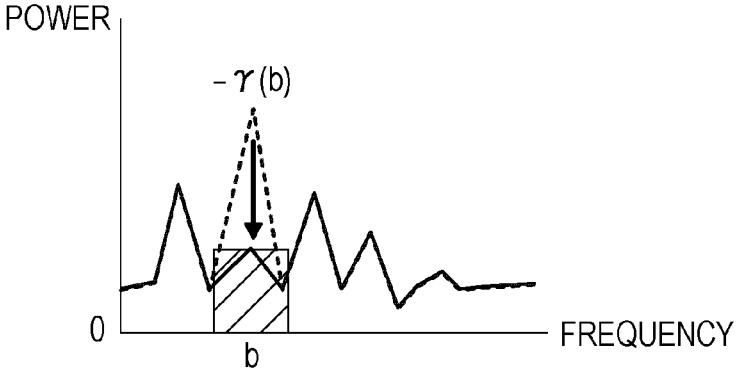

The detection method of the distortion detector 210 detecting the distortion 2=X (see FIG. 7C) is described below. The distortion detector 210 calculates the distortion 2$=\gamma$(b) for the similarity difference A(b) calculated in accordance with equation (23) based on the relationship of the pre-calculated similarity difference and the distortion 2. The distortion detector 210 thus continuously stores a stores a graph(relationship) on which the conversion table is based as illustrated in FIG. 9A. The distortion 2$=\gamma$(b) is a physical quantity that attenuates the power of a spectrum of a decoded audio at the frequency band b prior to correction by $\gamma$(b)[dB] (namely, $-\gamma$(b)) as illustrated in FIGS. 9B and 9C.

The distortion detector 210 converts the distortion 2$=\gamma$(b) in accordance with the following equation (24), and outputs the resulting physical quantity X as the distortion 2 in order to perform the spectrum power correction as a correction to the coefficient matrix H(b):

$$X = 10^{\frac{-\gamma(b)}{20}} \tag{24}$$

The correction process of the coefficient corrector 211 correcting the coefficient matrix H(b) is described below.

The coefficient corrector 211 calculates the corrected coefficient matrix H'(b) for the coefficient matrix H(b) calculated by the coefficient calculator 208 in accordance with the following equations (25) in view of equations (12), (17), and (18).

$$H' = \begin{bmatrix} h'_{11} & h'_{12} \\ h'_{21} & h'_{22} \end{bmatrix} \tag{25}$$

$$h'_{11} = C_l X_l \cos(\alpha+\theta_l), \qquad h'_{12} = C_l X_l \sin(\alpha+\theta_l)$$

$$h'_{21} = C_r X_r \cos(-(\alpha+\theta_r)), \quad h'_{22} = C_r X_r \sin(-(\alpha+\theta_r))$$

where an angle $\alpha$ is the angle $\alpha$ calculated by the coefficient calculator 208 in accordance with equation (17), and scale factors $C_l$ and $C_r$ are the scale factors $C_l$ and $C_r$ calculated by the coefficient calculator 208 in accordance with equation (18). The angle correction values $\theta=\theta_l=\theta_r$ and the power correction values $X=X_l=X_r$ are respectively the distortion 1 and the distortion 2 output by the distortion detector 210.

In accordance with the following equation (26), the stereophonic signal generator 212 decodes the L channel signal L(b,t) and the R channel signal R(b,t) based on the monophonic audio signal S(b,t) output from the SBR decoder 203 and the reverberation signal D(b,t) output from the decorrelator 206. Equation (26) is based on the corrected coefficient matrix H'(b) calculated by the coefficient corrector 211:

$$\begin{bmatrix} L(b,t) \\ R(b,t) \end{bmatrix} = \begin{bmatrix} h'_{11} & h'_{12} \\ h'_{21} & h'_{22} \end{bmatrix} \begin{bmatrix} s(b,t) \\ d(b,t) \end{bmatrix} \tag{26}$$

The parametric stereophonic decoding apparatus performs the above-described operations in every frequency band b while determining whether to perform the correction or not. In such operations, the operations of the distortion detector 210 and the coefficient corrector 211 is described further in detail.

Figure 10:
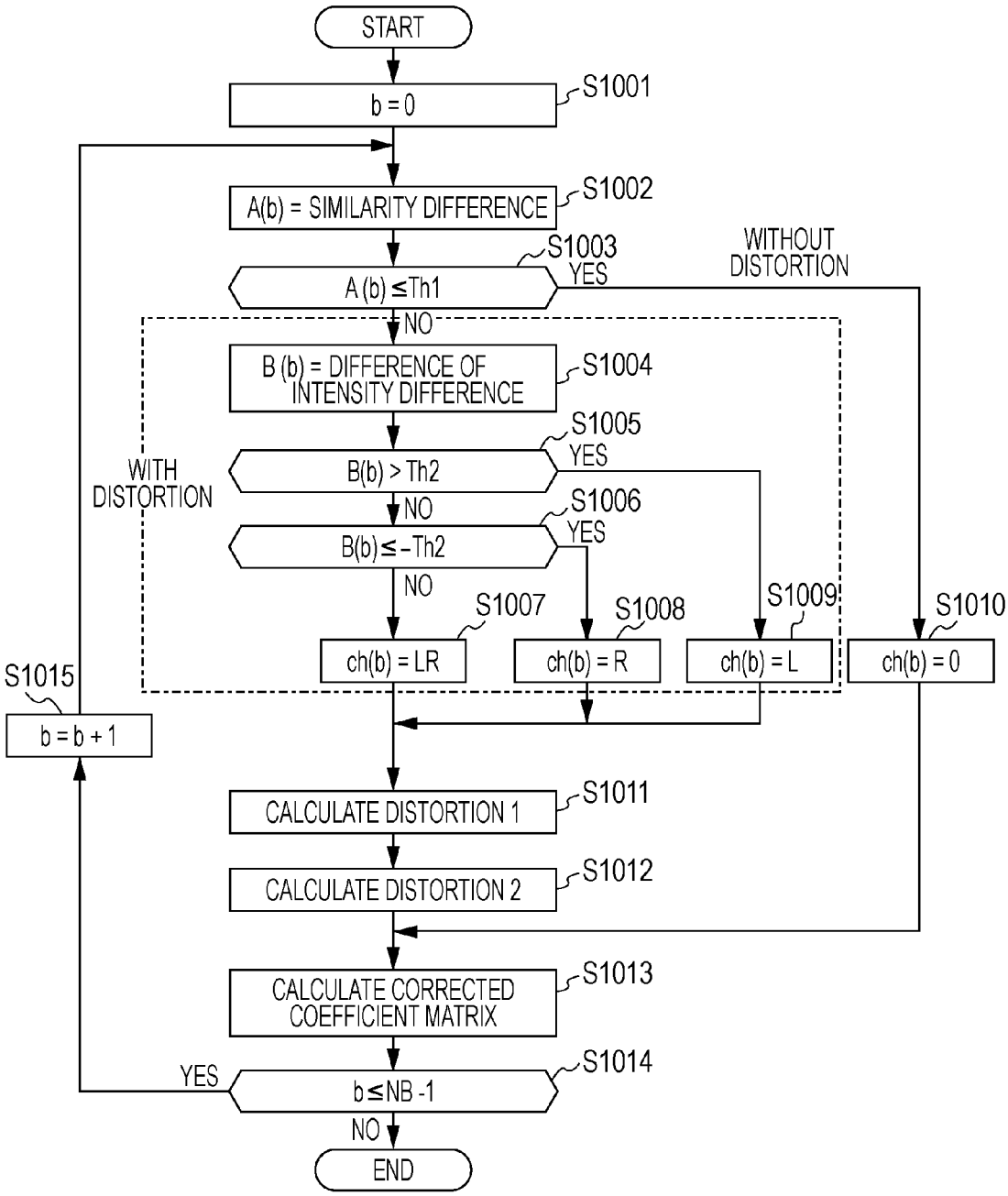
FIG. 10 is a flowchart illustrating a control operation of a distortion detector and a coefficient corrector.

FIG. 10 is an operational flowchart illustrating the operations of the distortion detector 210 and the coefficient corrector 211. In the discussion that follows, steps S1001-S1014 illustrated in FIG. 10 are referred to as appropriate.

The distortion detector 210 and coefficient corrector 211 set a frequency band number to zero in step S1001. The distortion detector 210 and coefficient corrector 211 perform a series of process steps from step S1001 to step S1013 at each frequency band b with the frequency band number in step S1015 incremented by 1 until it is determined in step S1014 whether the frequency band number exceeds a maximum value NB−1.

Figure 11A:
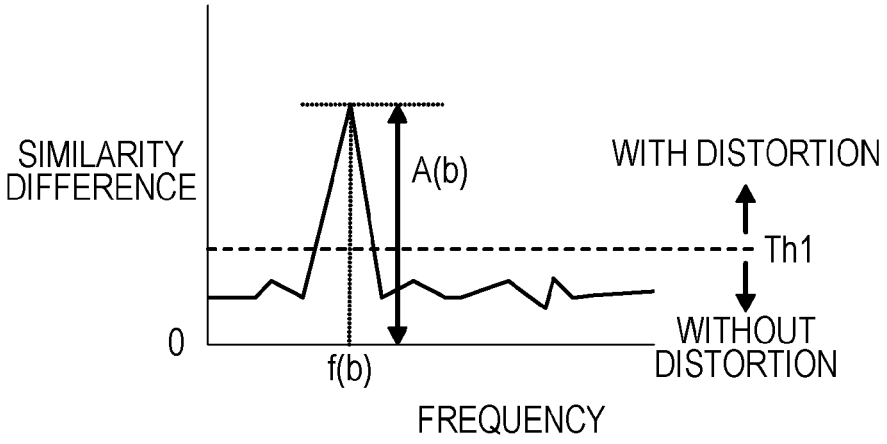
FIGS. 11A and 11B illustrate a detection operation of a distortion and a distortion-affected channel.

The distortion detector 210 calculates the similarity difference A(b) in accordance with equation (23) (step S1002). The distortion detector 210 compares the similarity difference A(b) with a threshold value Th1 (step S1003). Referring to FIG. 11A, the distortion detector 210 determines that no distortion exists if the similarity difference A(b) is equal to or smaller than the threshold value Th1, or determines that a distortion exists if the similarity difference A(b) is larger than the threshold value Th1. This determination is based on the principle discussed with reference to FIG. 4.

If the similarity difference A(b) is equal to or smaller than the threshold value Th1, the distortion detector 210 determines that no distortion exists. The distortion detector 210 then sets, to a variable ch(b) indicating a channel suffering from distortion at the frequency band b, a value zero meaning that none of the channels are to be corrected. Processing proceeds to step S1013 (step S1003→step S1010→step S1013).

If the similarity difference A(b) is larger than the threshold value Th1, the distortion detector 210 determines that a distortion exists, and then performs steps S1004-S1009.

In accordance with the following equation (27), the distortion detector 210 subtracts the value of the first intensity difference iid(b) output from the PS analyzer 207 of FIG. 2 from the value of the second intensity difference iid'(b) output from the decoded audio analyzer 209 of FIG. 2:

$$B(b)=iid'(b)-iid(b) \tag{27}$$

As a result, a difference B(b) between the intensity differences at the frequency band b is calculated (step S1004).

Figure 11B:
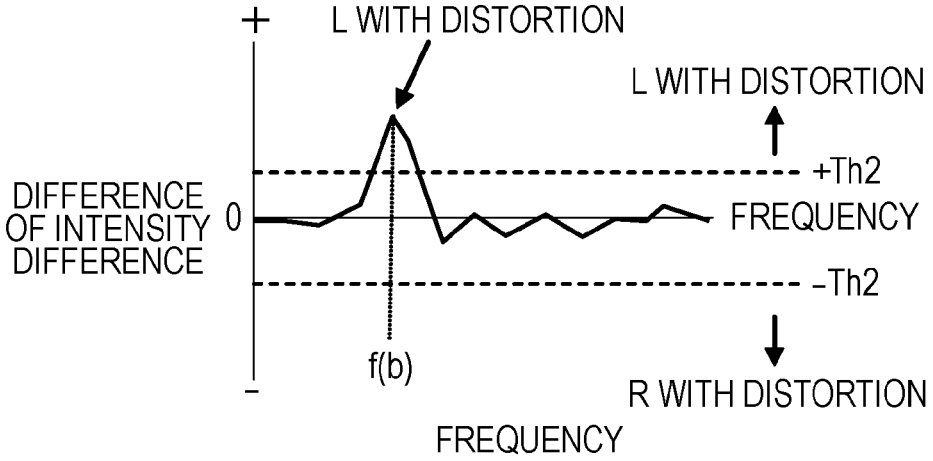

The distortion detector 210 compares the difference B(b) between the intensity differences with a threshold value Th2 and a threshold value −Th2 (steps S1005 and 1006). If the intensity difference B(b) is larger than the threshold value Th2 as illustrated in FIG. 11B, it is determined that the L channel suffers from distortion. If the difference B(b) is smaller than the threshold value −Th2, it is determined that the R channel suffers from distortion. If the difference B(b) is larger than the threshold value −Th2 but equal to or smaller than the threshold value Th2, it is determined that both channels suffer from distortion.

A larger value of the first intensity difference iid(b) in the calculation of the first intensity difference iid(b) in accordance with equation (15) shows that the power of the L channel is stronger. If this tendency is more pronounced on the decoder side than on the encoder side, i.e., if the difference B(b) is above the threshold value Th2, a stronger distortion component is superimposed on the L channel. Conversely, a smaller value of the first intensity difference iid(b) means that the power of the R channel is higher. If this tendency is more pronounced on the decoder side than on the encoder side, i.e., if the difference B(b) is below the threshold value −Th2, a stronger distortion component is superimposed on the R channel.

In other words, if the difference B(b) is larger the threshold value Th2, the distortion detector 210 determines that the L channel suffers from distortion. The distortion detector 210 thus sets a value L to the distortion-affected channel ch(b), and then proceeds to step S1011 (step S1005→step S1009→step S1011).

If the difference B(b) is equal to or smaller than the threshold value −Th2, the distortion detector 210 determines that the R channel suffers from distortion. The distortion detector 210 thus sets a value R to the distortion-affected channel ch(b), and then proceeds to step S1011 (step S1005→step S1006→step S1008→step S1011).

If the difference B(b) is larger the threshold value −Th2 but equal to or smaller than the threshold value Th2, the distortion detector 210 determines that both channels suffer from distortion. The distortion detector 210 thus sets a value LR to the distortion-affected channel ch(b), and then proceeds to step S1011 (step S1005→step S1006→step S1007→step S1011).

Subsequent to any one of steps S1007-S1009, the distortion detector 210 calculates the distortion 1. As previously discussed, the distortion detector 210 calculates equation (22) based on the first similarity icc(b) at the frequency band b calculated by the PS analyzer 207 and the second similarity icc'(b) at the frequency band b calculated by the decoded audio analyzer 209. As a result, the distortion 1=θ (=θ(b)) at the frequency band b is calculated.

The distortion detector 210 then calculates the distortion 2. As previously discussed, the distortion detector 210 calculates the physical quantity γ(b) for the similarity difference A(b) calculated in step S1002 based on the relationship of the pre-calculated similarity difference and the distortion 2. The distortion detector 210 further calculates the distortion 2=X for the physical quantity γ(b) in accordance with equation (24).

In this way, the distortion detector 210 detects the distortion-affected channel ch(b), the distortion 1 and the distortion 2 at the frequency band b. These pieces of information are then transferred to the coefficient corrector 211 (step S1011→step S1012→step S1013).

If the value LR is set to the distortion-affected channel, the coefficient corrector 211 calculates the corrected coefficient matrix H'(b) based on the angular correction values $\theta_l=\theta_r=\theta$ (distortion 1) and the power correction values $X_l=X_r=X$ (distortion 2) in accordance with equation (25).

If the value R is set to the distortion-affected channel, the coefficient corrector 211 calculates the corrected coefficient matrix H'(b) based on the angular correction values $\theta_r=\theta$ (distortion 1) and $\theta_l=\theta$, and the power correction values $X_l=X$ (distortion 2) and $X_r=1$ in accordance with equation (25).

If the value L is set to the distortion-affected channel, the coefficient corrector 211 calculates the corrected coefficient matrix H'(b) based on the angular correction values $\theta_l=\theta$ (distortion 1) and $\theta_r=\theta$ and the power correction values $X_l=X$ (distortion 2) and $X_r=1$ in accordance with equation (25).

If the value zero is set to the distortion-affected channel, the coefficient corrector 211 calculates the corrected coefficient matrix H'(b) based on the angular correction values $\theta_l=\theta_r=0$ and the power correction values $X_l=X_r=1$ in accordance with equation (25).

Figure 12:
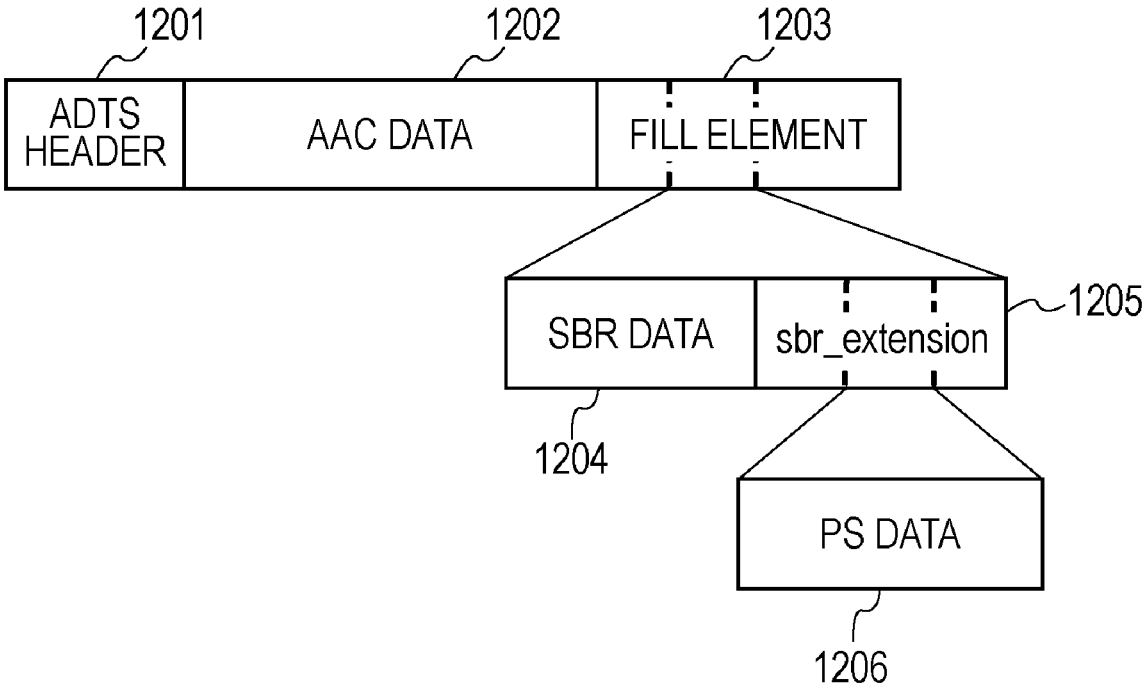
FIG. 12 illustrates a data format of input data.

FIG. 12 illustrates a data format of the data input to the reception processor 101 of FIG. 2. The data format illustrated in FIG. 12 complies with the audio data transport stream (ADTS) adopted in MPEG-4 Audio of the HE-AAC v2 decoder.

The input data mainly includes an ADTS header 1201, AAC data 1202 as monophonic audio AAC encoded data, and an extension data region (FILL element) 1203.

SBR data 1204 as monophonic audio SBR encoded data and SBR extension data (sbr_extension) 1205 are included in the FILL element 1203.

Parametric stereophonic PS data 1206 is stored in sbr_extension 1205. Parameters needed for a PS decoding operation, such as the first similarity icc(b) and the first intensity difference iid(b), are contained in the PS data 1206.

Third Embodiment

A third embodiment is described below. The third embodiment is different in the operation of the coefficient corrector 211 from the second embodiment illustrated in FIG. 2. The rest of the third embodiment remains unchanged in structure from the second embodiment.

In accordance with the second embodiment, the relationship used by the coefficient corrector 211 in the determination of $\gamma(b)$ from the similarity difference A(b) is fixed. In accordance with the third embodiment, an appropriate relationship may be used in response to the power of a decoded audio signal.

Figure 13:
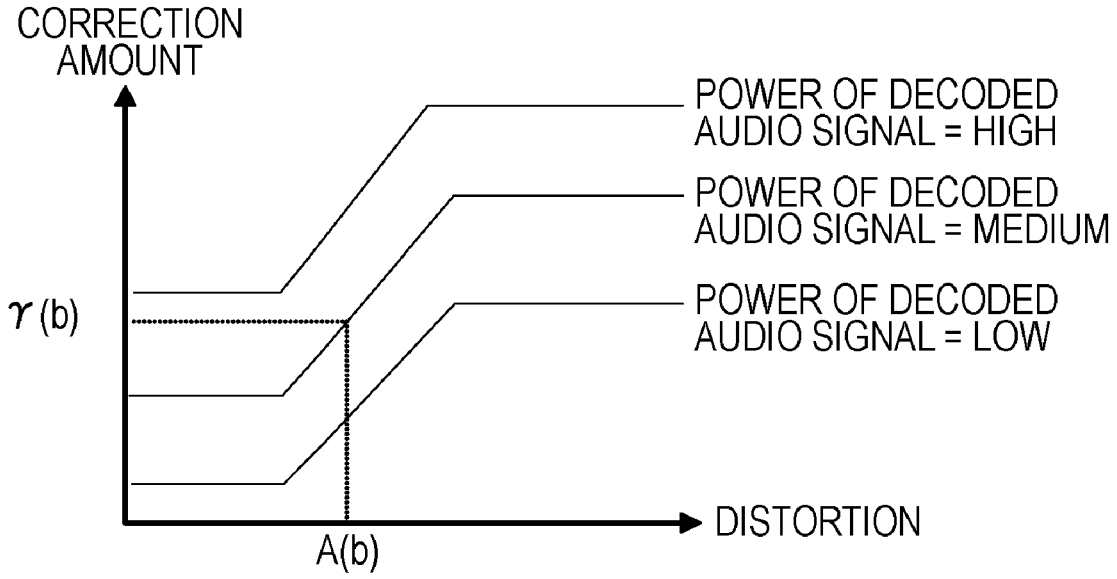
FIG. 13 illustrates a third embodiment.

If the power of the decoded audio signal is high as illustrated in FIG. 13, a correction value for the distortion becomes large. If the power of the decoded audio signal is low, a correction value for the distortion becomes small. To this end, a plurality of relationships are used.

The "power of the decoded audio signal" refers to the power of the decoded L channel signal L'(b,t) or the decoded R channel signal R'(b,t), calculated by the decoded audio analyzer 209, at the frequency band b of the channel to be corrected.

Fourth Embodiment

A fourth embodiment is described.

Figure 14:
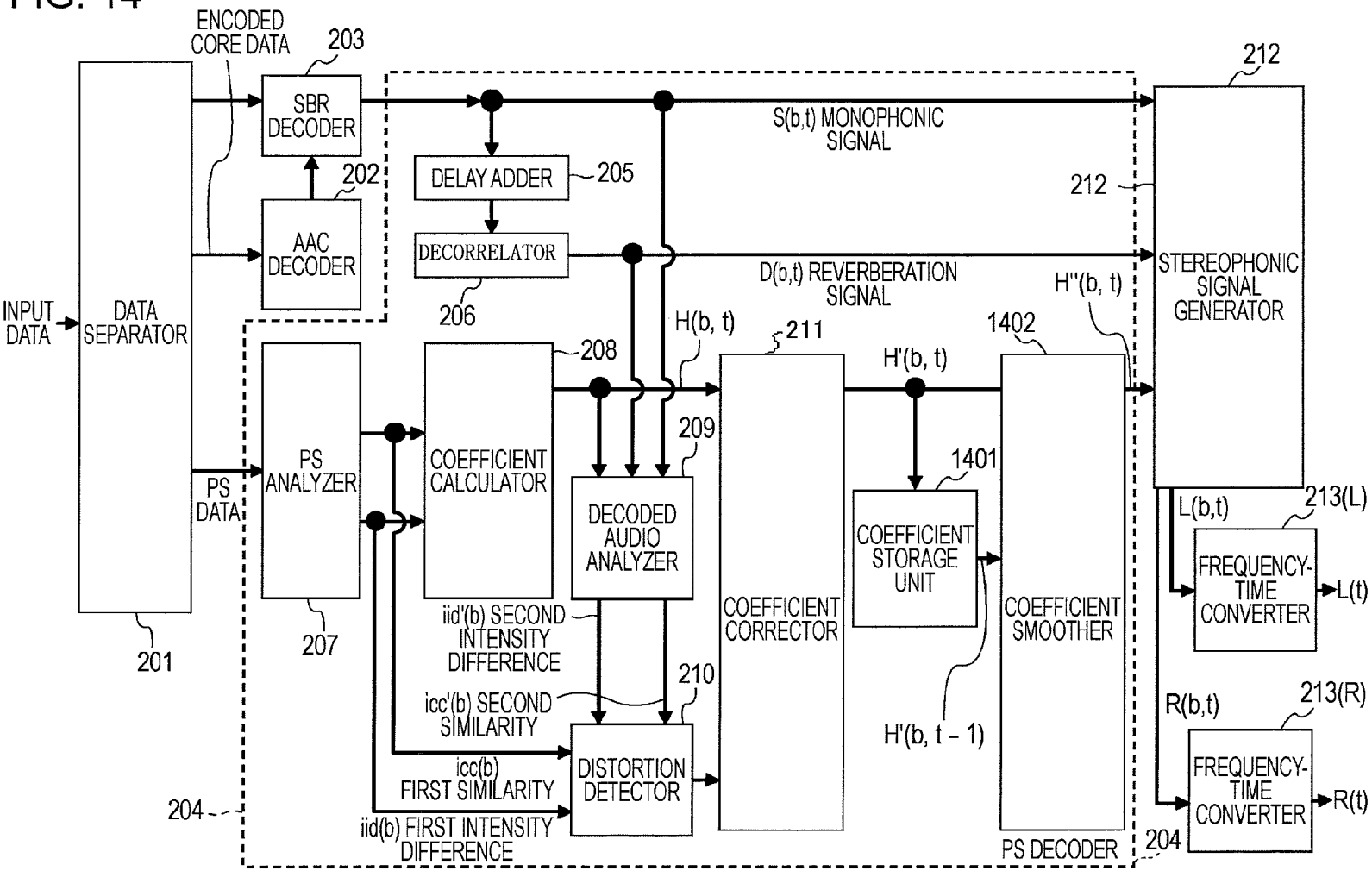
FIG. 14 illustrates a structure of a fourth embodiment.

FIG. 14 illustrates a structure of the parametric stereophonic decoding apparatus of the fourth embodiment.

Referring to FIG. 14, elements described with the same reference numerals as those of the first embodiment of FIG. 2 have the same functions. The difference between the structure of FIG. 14 and the structure of FIG. 2 is that the fourth embodiment includes a coefficient storage unit 1401 and a coefficient smoother 1402 for smoothing the corrected coefficient matrix H'(b) output from the coefficient corrector 211.

Every discrete time t, the coefficient storage unit 1401 successively stores a corrected coefficient matrix (hereinafter referred to as H'(b,t)) output from the coefficient corrector 211 while outputting, to the coefficient smoother 1402, a corrected coefficient matrix (hereinafter referred to as H'(b,t−1)) at time (t−1) one discrete time unit before.

Using the corrected coefficient matrix H'(b,t) at discrete time t output from the coefficient corrector 211, the coefficient smoother 1402 smoothes each coefficient (see equation (25)) forming the corrected coefficient matrix H'(b,t−1) at time (t−1) one discrete time unit before input from the coefficient storage unit 1401. The coefficient smoother 1402 thus outputs the resulting matrix to the stereophonic signal generator 212 as the corrected coefficient matrix H"(b,t−1).

A smoothing technique of the coefficient smoother 1402 is not limited to any particular one. For example, a technique of weighted summing the output from the coefficient storage unit 1401 and the output from the coefficient corrector 211 at each coefficient may be used.

Alternatively, a plurality of past frames output from the coefficient corrector 211 may be stored on the coefficient storage unit 1401, and the plurality of past frames and the output from the coefficient corrector 211 may be weighted summed for smoothing.

The smoothing operation is not limited to the time axis. The smoothing operation may be performed on the output from the coefficient corrector 211 in the direction of the frequency band b. More specifically, the weighted summing operation for smoothing may be performed on the coefficients forming the corrected coefficient matrix H'(b,t) at the frequency band b output from the coefficient corrector 211, the coefficients at the frequency band b−1 and the coefficients at the frequency band b+1. When the weighted summing operation is performed, the corrected coefficient matrices output from the coefficient corrector 211 at a plurality of adjacent frequency bands may be used.

Supplementary to First Through Fourth Embodiments

Figure 15:
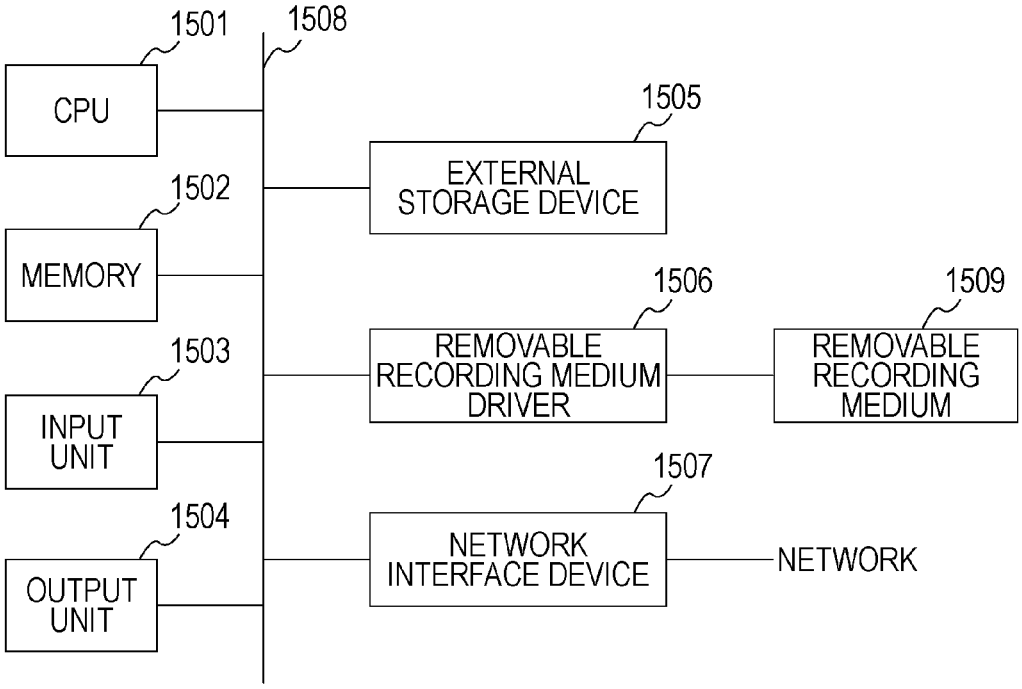
FIG. 15 illustrates a hardware structure of a computer implementing a system of each of the first through fourth embodiments.
Figure 16:
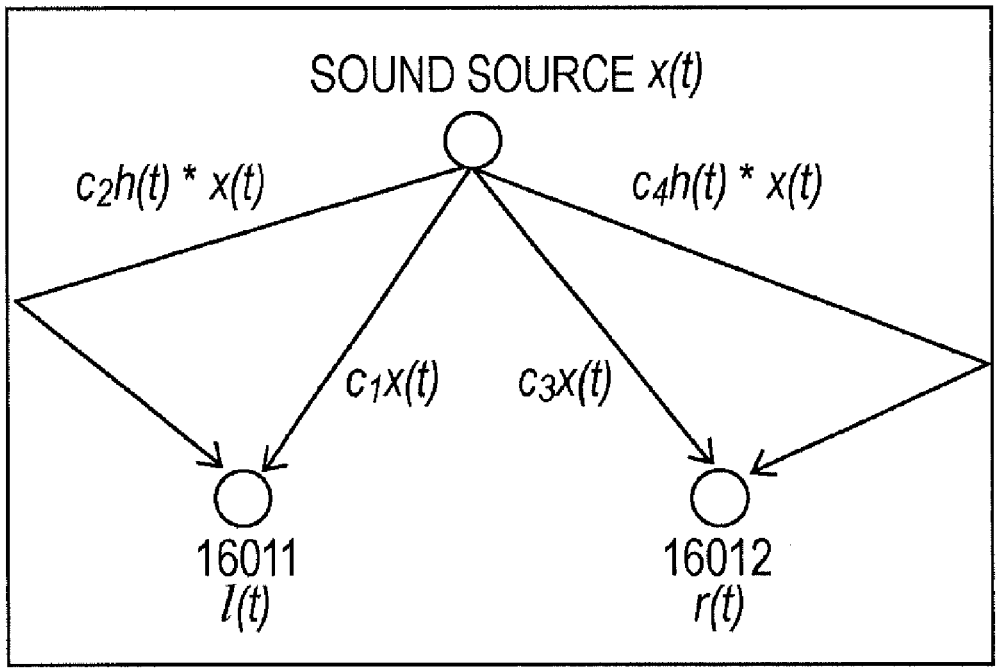
FIG. 16 RELATED ART
FIG. 16 illustrates a model of stereophonic recording.
Figure 17:
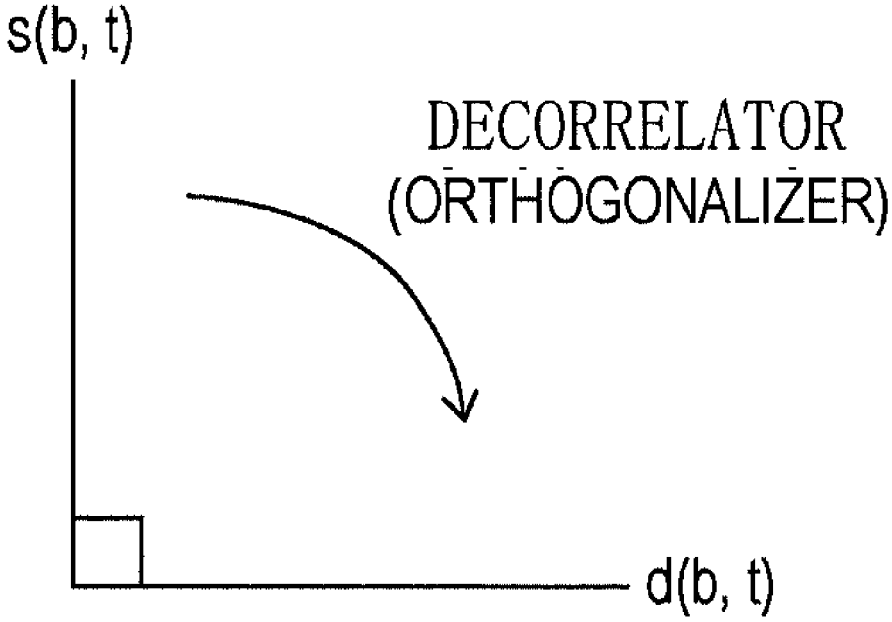
FIG. 17 RELATED ART
FIG. 17 illustrates a decorrelation operation.

FIG. 15 illustrates a computer hardware structure of a system incorporating the first through fourth embodiments.

The computer illustrated in FIG. 15 includes a CPU 1501, a memory 1502, an input unit 1503, an output unit 1504, an external storage device 1505, a removable recording medium driver 1506 receiving a removable recording medium 1509, and a network interface device 1507 with all the elements interconnected via bus 1508. The structure illustrated in FIG. 15 is an example of computer implementing the above-described system, and such a computer is not limited to the structured described here.

The CPU 1501 generally controls the computer. When programs are executed or data is updated, the memory 1502 such as a RAM or the like stores a program stored on the external storage device 1505 (or the removable recording medium 1509) or data. The CPU 1501 reads the program onto the memory 1502 and executes the read program, thereby generally controlling the computer.

The input unit 1503 includes a keyboard, a mouse, etc. and interfaces thereof. The input unit 1503 detects an input operation performed on the keyboard, the mouse, etc. by a user, and notifies the CPU 1501 of the detection results.

The output unit 1504 includes a display, a printer, etc., and interfaces thereof. The output unit 1504 outputs data supplied under the control of the CPU 1501 to the display or the printer.

The external storage device 1505 may be a hard disk storage, for example and may be mainly used to store a variety of data and programs. The removable recording medium driver 1506 receives the removable recording medium 1509 such as an optical disk, a synchronous dynamic random access memory (SDRAM), or a Compact Flash (registered trademark). The removable recording medium driver 1506 serves as an auxiliary unit to the external storage device 1505.

The network interface device 1507 connects to a local-area network (LAN) or a wide-area network (WAN). The parametric stereophonic decoding system according to of the first through fourth embodiments is implemented by the CPU 1501 that executes the program incorporating the functions as described above. The program may be distributed in the external storage device 1505 or the removable recording medium 1509 or may be acquired via the network by the network interface device 1507.

In the first through fourth embodiments, the present invention is applied to the parametric stereophonic decoding apparatus. The present invention is not limited to the parametric stereophonic apparatus. The present invention may be applicable to a variety of systems including a surround system in which the decoding process is performed with audio decoded auxiliary information combined with the decoded audio signal.

All examples and conditional language recited herein are intended for pedagogical purposes to aid the reader in understanding the invention and the concepts contributed by the inventor to furthering the art, and are to be constructed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A parametric stereophonic decoding apparatus comprising:

a processor; and a memory which stores a plurality of instructions, which when executed by the processor, cause the processor to execute, acquiring, from encoded audio data, a reception audio signal and first auxiliary decoded audio information;

calculating coefficient information from the first auxiliary decoded audio information;

generating a decoded output audio signal based on the coefficient information and the reception audio signal;

decoding to result in a decoded audio signal based on the first auxiliary decoded audio signal and the reception audio signal, and calculating, from the decoded audio signal, second auxiliary decoded audio information corresponding to the first auxiliary decoded audio information;

detecting a distortion caused in a decoding operation of the decoded audio signal by comparing the second auxiliary decoded audio information with the first auxiliary decoded audio information; and correcting the coefficient information in response to the distortion detected by the distortion detector, and supplying the corrected coefficient information to the output signal generator.

2. An audio decoding apparatus comprising:

a processor; and a memory which stores a plurality of instructions, which when executed by the processor, cause the processor to execute, acquiring a monophonic audio signal, a reverberation audio signal, and parametric stereophonic parameter information from audio data encoded through a parametric stereophonic system;

calculating coefficient information from the parametric stereophonic parameter information;

generating a stereophonic output audio signal decoded in accordance with the coefficient information, the monophonic audio signal, and the reverberation audio signal;

decoding to result in a decoded audio signal based on the parametric stereophonic parameter information as first parametric stereophonic parameter information, the monophonic audio signal, and the reverberation audio signal, and calculating, from the decoded audio signal, second parametric stereophonic parameter information corresponding to the first parametric stereophonic parameter information;

detecting a distortion caused in a decoding operation of the decoded audio signal by comparing the second parametric stereophonic parameter information with the first parametric stereophonic parameter information; and correcting the coefficient information in response to the distortion detected, and supplying the corrected coefficient information to an output signal generator.

3. The audio decoding apparatus according to claim 2, wherein the parametric stereophonic parameter information includes similarity information indicating a similarity between stereophonic audio channels, and the processor executes:

calculating, from the decoded audio signal, second similarity information corresponding to first similarity information of the first parametric stereophonic parameter information, comparing the second similarity information with the first similarity information in each frequency band to detect the distortion caused in the decoding operation of the decoded audio signal of each frequency band and each stereophonic audio channel, and correcting the coefficient information in response to the distortion detected by the distortion detector in each frequency band and each stereophonic audio channel.

4. The audio decoding apparatus according to claim 3, wherein the parametric stereophonic parameter information also includes intensity difference information related to an intensity difference between signals of the stereophonic audio channels, and the processor executes:

calculating, from the decoded audio signal, second intensity difference information corresponding to first intensity difference information of the first parametric stereophonic parameter information, comparing the second intensity difference information with the first intensity difference information in each frequency band to detect, for each frequency band, an audio channel causing the distortion, and correcting, in each frequency band, the coefficient information corresponding to the audio channel detected.

5. The audio decoding apparatus according to claim 2, wherein the processor executes:

smoothing the coefficient information, corrected by the coefficient corrector, in a time axis direction or a frequency axis direction.

6. The audio decoding apparatus according to claim 2, wherein the decoding of the audio signal, the detecting of the distortion, and the correcting of the coefficient information are performed in a time-frequency domain.

7. A parametric stereophonic decoding method comprising:

acquiring, from encoded audio data, a reception audio signal and first auxiliary decoded audio information;

calculating, using a processor, coefficient information from the first auxiliary decoded audio information;

generating a decoded output audio signal based on the coefficient information and the reception audio signal;

decoding to result in a decoded audio signal based on the first auxiliary decoded audio signal and the reception audio signal;

calculating, from the decoded audio signal, second auxiliary decoded audio information corresponding to the first auxiliary decoded audio information;

detecting a distortion caused in a decoding operation of the decoded audio signal by comparing the second auxiliary decoded audio information with the first auxiliary decoded audio information;

correcting the coefficient information in response to the detected distortion; and supplying the corrected coefficient information as the coefficient information when generating the decoded output audio signal.

8. An audio decoding method comprising:

acquiring a monophonic audio signal, a reverberation audio signal, and parametric stereophonic parameter information from audio data encoded through a parametric stereophonic system;

calculating, using a processor, coefficient information from the parametric stereophonic parameter information;

generating a stereophonic output audio signal decoded in accordance with the coefficient information, the monophonic audio signal, and the reverberation audio signal;

decoding to result in a decoded audio signal based on the parametric stereophonic parameter information as first parametric stereophonic parameter information, the monophonic audio signal, and the reverberation audio signal;

calculating, from the decoded audio signal, second parametric stereophonic parameter information corresponding to the first parametric stereophonic parameter information;

detecting a distortion caused in a decoding operation of the decoding audio signal by comparing the second parametric stereophonic parameter information with the first parametric stereophonic parameter information;

correcting the coefficient information in response to the detected distortion; and supplying the corrected coefficient information as the coefficient information when generating the stereophonic output audio signal.

9. The audio decoding method according to claim 8, wherein the parametric stereophonic parameter information includes similarity information indicating a similarity between stereophonic audio channels;

in the calculating of the second parametric stereophonic parameter information, second similarity information corresponding to first similarity information as the first parametric stereophonic parameter information is calculated from the decoded audio signal;

the distortion caused in the decoding operation of the decoded audio signal in each frequency band and in each stereophonic audio channel is detected by comparing the second similarity information with the first similarity information in each frequency band; and the coefficient information is corrected in response to the distortion detected in each frequency band and in each stereophonic audio channel.

10. The audio decoding method according to claim 9, wherein the parametric stereophonic parameter information includes intensity difference information related to an intensity difference between signals of the stereophonic audio channels;

in the calculating of the second parametric stereophonic parameter information, second intensity difference information corresponding to the first intensity difference information of the first parametric stereophonic parameter information is calculated from the decoded audio signal;

in the detecting of the distortion, an audio channel causing the distortion is detected in each frequency band by comparing the second intensity difference information with the first intensity difference information in each frequency band; and the coefficient information corresponding to the detected audio channel in each frequency band is corrected.

11. The audio decoding method according to claim 8, further comprising smoothing the corrected coefficient information in a time axis direction or a frequency axis direction.

12. The audio decoding method according to claim 8, wherein the analyzing of the decoded audio signal, the detecting of the distortion, and the correcting of the coefficient information are performed in a time-frequency domain.

13. A computer-readable storage medium including a program to cause a parametric stereophonic decoding apparatus to execute operations, the program comprising:

acquiring, from encoded audio data, a reception audio signal and first auxiliary decoded audio information;

calculating coefficient information from the first auxiliary decoded audio information;

generating a decoded output audio signal based on the coefficient information and the reception audio signal;

decoding to result in a decoded audio signal based on the first auxiliary decoded audio signal and the reception audio signal;

calculating, from the decoded audio signal, second auxiliary decoded audio information corresponding to the first auxiliary decoded audio information;

detecting a distortion caused in a decoding operation of the decoded audio signal by comparing the second auxiliary decoded audio information with the first auxiliary decoded audio information;

correcting the coefficient information in response to the detected distortion; and supplying the corrected coefficient information as the coefficient information when generating the decoded output audio signal.

14. A computer-readable storage medium including a program to cause an audio decoding apparatus to execute operations, the program comprising:

acquiring a monophonic audio signal, a reverberation audio signal, and parametric stereophonic parameter information from audio data encoded through a parametric stereophonic system;

calculating coefficient information from the parametric stereophonic parameter information;

generating a stereophonic output audio signal decoded in accordance with the coefficient information, the monophonic audio signal, and the reverberation audio signal;

decoding to result in a decoded audio signal based on the parametric stereophonic parameter information as first parametric stereophonic parameter information, the monophonic audio signal, and the reverberation audio signal;

calculating, from the decoded audio signal, second parametric stereophonic parameter information corresponding to the first parametric stereophonic parameter information;

detecting a distortion caused in the decoding operation of the decoded audio signal by comparing the second parametric stereophonic parameter information with the first parametric stereophonic parameter information;

correcting the coefficient information in response to the detected distortion; and supplying the corrected coefficient information as the coefficient information when generating the stereophonic output audio signal.

15. The computer-readable storage medium according to claim 14, wherein the parametric stereophonic parameter information includes similarity information indicating a similarity between stereophonic audio channels;

in the calculating of the second parametric stereophonic parameter information, second similarity information corresponding to first similarity information of the first parametric stereophonic parameter information is calculated from the decoded audio signal;

the distortion caused in the decoding operation of the decoded audio signal in each frequency band and in each stereophonic audio channel is detected by comparing the second similarity information with the first similarity information in each frequency band; and the coefficient information is corrected in response to the distortion detected in each frequency band and in each stereophonic audio channel.

16. The computer-readable storage medium according to claim 15, wherein the parametric stereophonic parameter information includes intensity difference information related to an intensity difference between signals of the stereophonic audio channels;

in the calculating of the second parametric stereophonic parameter information, second intensity difference information corresponding to the first intensity difference information of the first parametric stereophonic parameter information is calculated from the decoded audio signal;

in the detecting of the distortion, an audio channel causing from the distortion is detected in each frequency band by comparing the second intensity difference information with the first intensity difference information in each frequency band; and the coefficient information is corrected at the detected audio channel in each frequency band.

17. The computer-readable storage medium according to claim 14, wherein the program further comprises smoothing the corrected coefficient information in a time axis direction or a frequency axis direction.

18. The computer-readable storage medium according to claim 14, wherein the analyzing of the decoded audio signal, the detecting of the distortion, and the correcting of the coefficient information are performed in a time-frequency domain.

* * * * *